US010907843B2

(12) United States Patent
Penlesky et al.

(10) Patent No.: US 10,907,843 B2
(45) Date of Patent: Feb. 2, 2021

(54) VENTILATING SYSTEM AND METHOD

(75) Inventors: Robert G. Penlesky, Waukesha, WI (US); Mirko Zakula, New Berlin, WI (US); Daniel L. Karst, Beaver Dam, WI (US); Corey S. Jacak, West Bend, WI (US)

(73) Assignee: Broan-NuTone LLC, Hartford, WI (US)

( * ) Notice: Subject to any disclaimer, the term of this patent is extended or adjusted under 35 U.S.C. 154(b) by 981 days.

(21) Appl. No.: 13/300,304

(22) Filed: Nov. 18, 2011

(65) Prior Publication Data

US 2013/0130612 A1 May 23, 2013

(51) Int. Cl.

| | |
|---|---|
| ***F24F 7/007*** | (2006.01) |
| ***F24F 13/078*** | (2006.01) |
| ***F21V 33/00*** | (2006.01) |
| ***E04B 9/00*** | (2006.01) |

(52) U.S. Cl.

CPC ..... *F24F 7/007* (2013.01); *E04B 9/006* (2013.01); *F21V 33/0088* (2013.01); *F24F 13/078* (2013.01)

(58) Field of Classification Search

CPC .... F24F 7/02; F24F 7/013; F24F 7/06; F16M 13/027; Y10T 29/49627

USPC ..... 454/243, 237, 249; 285/24, 123.1; 248/200, 200.1, 201, 317, 343, 673–675, 248/298.1, 225.11, 227.4; 362/365, 366, 362/370, 371

See application file for complete search history.

(56) References Cited

U.S. PATENT DOCUMENTS

| | | | | |
|---|---|---|---|---|
| 1,982,957 A * | 12/1934 | John Knell | ..... | H02G 3/126 220/3.9 |
| 3,422,261 A * | 1/1969 | McGinty | ..... | F21S 8/02 362/296.01 |
| 3,965,933 A * | 6/1976 | Beaudin | ..... | 137/875 |
| 4,165,851 A * | 8/1979 | Bowden, Jr. | ..... | H02G 3/126 248/217.3 |

(Continued)

FOREIGN PATENT DOCUMENTS

| | | |
|---|---|---|
| CN | 1654881 A | 8/2005 |
| CN | 101144483 A | 3/2008 |

OTHER PUBLICATIONS

"International Application Serial No. PCT/US2012/064761, International Preliminary Report on Patentability dated May 30, 2014", 9 pgs.

(Continued)

*Primary Examiner* — Steven B McAllister
*Assistant Examiner* — Frances F. Hamilton
(74) *Attorney, Agent, or Firm* — Barnes & Thornburg LLP

(57) ABSTRACT

A ventilating system including a housing, a ventilating assembly and a mounting assembly coupled to the housing. The mounting assembly can include two support members, two first mounting brackets, two second mounting brackets, and two third mounting brackets. The third mounting brackets include a first and second flange, and the second mounting brackets include bendable tabs to secure the mounting assembly to a structure. The first mounting brackets each include lead in features comprising an alignment plate and a pair of guiding plates. The first mounting brackets include a portion between the lead in features that is spaced from the lead in features to provide housing clearance.

17 Claims, 34 Drawing Sheets

(56) References Cited

U.S. PATENT DOCUMENTS 4,336,749 A * 6/1982 Barnhart ..... F24F 13/20 248/58
4,406,216 A 9/1983 Holt et al.
4,511,113 A * 4/1985 Druffel ..... F21S 8/02 248/216.4
4,867,640 A * 9/1989 Penlesky ..... F04D 29/626 415/204
5,080,403 A * 1/1992 Paoluccio ..... F16L 41/00 285/189
5,160,811 A * 11/1992 Ritzmann ..... 174/68.3
5,469,893 A * 11/1995 Caveney ..... G02B 6/4459 138/157
5,498,204 A * 3/1996 Anderson et al. ..... 454/359
5,505,419 A * 4/1996 Gabrius ..... F21V 21/04 248/200.1
5,690,423 A * 11/1997 Hentz ..... F21S 8/02 248/302
5,879,232 A * 3/1999 Luter, II ..... F04D 25/08 454/349
5,957,574 A * 9/1999 Hentz ..... F21S 8/02 248/302
6,004,011 A * 12/1999 Sieczkowski ..... F21S 8/026 362/365
6,076,788 A * 6/2000 Akiyama ..... E04B 9/006 248/200.1
6,142,865 A * 11/2000 Noblet ..... B60H 1/00014 454/137
6,183,360 B1 * 2/2001 Luter et al. ..... 454/366
6,203,423 B1 * 3/2001 Craw et al. ..... 454/359
6,209,622 B1 * 4/2001 Lagace et al. ..... 165/8
6,272,794 B1 * 8/2001 Rippel ..... F21S 8/02 248/343
6,273,145 B1 * 8/2001 Botting ..... 138/166
6,616,193 B2 * 9/2003 Anderson ..... 285/140.1
6,729,083 B1 * 5/2004 Soyko ..... E04D 13/0305 248/298.1
6,830,065 B2 * 12/2004 Sinur et al. ..... 137/527.8
6,979,169 B2 * 12/2005 Penlesky ..... F04D 29/4226 415/1
7,140,960 B2 * 11/2006 Pilger ..... F24F 13/06 454/292
7,175,309 B2 * 2/2007 Craw ..... F21V 29/02 362/149
7,203,416 B2 * 4/2007 Craw ..... F24H 3/0411 392/350
7,455,432 B2 * 11/2008 Craw ..... F21V 29/02 362/149
7,455,500 B2 * 11/2008 Penlesky ..... F04D 29/4226 415/206
7,470,043 B2 12/2008 Mehta
7,645,189 B2 * 1/2010 Pilger ..... F24F 13/02 248/57
7,654,495 B2 * 2/2010 Adrian ..... F04D 25/088 248/200.1
7,874,539 B2 * 1/2011 Wright ..... F04D 25/088 248/323
7,874,708 B1 * 1/2011 Jones ..... F21V 21/048 248/220.22
7,952,022 B2 * 5/2011 Rippel ..... H02G 3/125 174/50
8,240,630 B2 * 8/2012 Wronski ..... F21V 21/048 248/200.1
8,475,014 B2 * 7/2013 Jones ..... F21V 21/048 248/220.22
8,672,734 B2 * 3/2014 Labrecque ..... A01K 1/0052 454/259
8,727,583 B2 * 5/2014 Russo ..... F21V 21/04 362/364
8,800,943 B2 * 8/2014 Long ..... F04D 25/08 248/200.1
8,961,126 B1 * 2/2015 Tom ..... F21V 29/02 362/368
9,028,212 B1 * 5/2015 Tom ..... F04D 1/04 416/5
9,097,265 B1 * 8/2015 Tom ..... F04D 29/626
9,194,602 B2 * 11/2015 Hu ..... F24F 13/20
2004/0130154 A1 * 7/2004 Stepp et al. ..... 285/424
2005/0117341 A1 * 6/2005 Craw ..... F21V 29/02 362/253
2006/0073008 A1 * 4/2006 Penlesky ..... F04D 29/4226 415/1
2007/0075206 A1 * 4/2007 Wright ..... F04D 25/088 248/343
2008/0007046 A1 * 1/2008 Barboza ..... F16L 5/10 285/136.1
2008/0011928 A1 * 1/2008 Adrian ..... F04D 25/088 248/343
2008/0192490 A1 * 8/2008 Brown ..... F21V 21/04 362/365
2008/0304269 A1 * 12/2008 Pickard ..... F21V 21/048 362/365
2008/0318513 A1 * 12/2008 Adib ..... 454/319
2008/0318514 A1 * 12/2008 Fettkether ..... F24F 13/0218 454/330
2009/0139295 A1 * 6/2009 Motoo ..... B21D 41/02 72/370.06
2009/0170421 A1 7/2009 Adrian et al.
2009/0231861 A1 * 9/2009 Wedekind ..... H02G 3/20 362/365
2010/0020551 A1 * 1/2010 Kay ..... F21V 21/34 362/365
2010/0072746 A1 * 3/2010 Jensen ..... F16L 27/0841 285/197
2010/0110705 A1 * 5/2010 Nguyen ..... E04B 9/006 362/432
2010/0165643 A1 * 7/2010 Russo ..... F21V 21/04 362/365
2010/0201121 A1 * 8/2010 Jensen ..... F16L 41/086 285/189
2010/0201122 A1 * 8/2010 Zhi ..... 285/189
2010/0227541 A1 * 9/2010 Dietz ..... F24F 11/0001 454/256
2012/0014789 A1 * 1/2012 Shirahama ..... F04D 27/009 415/224
2012/0087138 A1 * 4/2012 Pringle ..... E04B 9/02 362/373
2013/0203336 A1 * 8/2013 Karst ..... F24F 7/04 454/249

OTHER PUBLICATIONS

WIPO Search Report and Written Opinion dated Mar. 11, 2013 for corresponding Application No. PCT/US2012/064761; 11 sheets.
"Chinese Application Serial No. 201210004625.6, Office Action dated May 18, 2016", (w/ English Translation), 15 pgs.
"Australian Application Serial No. 2012339793, First Examiner Report dated May 19, 2016", 3 pgs.
"Australian Application Serial No. 2012339793, Response filed Sep. 29, 2016 to First Examiner Report dated May 19, 2016", 26 pgs.
"Chinese Application Serial No. 201210004625.6, Office Action dated Mar. 29, 2017" (w/English Translation), 8 pages.
"Chinese Application Serial No. 201210004625.6, Response to Office Action dated Jun. 28, 2017", 7 pages.
"Chinese Application Serial No. 201210004625.6, Office Action dated Nov. 9, 2017" (w/English Translation), 7 pages.
"Chinese Application Serial No. 201210004625.6, Response to Office Action dated Jan. 18, 2018", 9 pages.
Response filed in corresponding Canadian Patent Application 2762259, dated Apr. 26, 2017 (6 pages).
Fourth Office Action issued in corresponding Chinese Patent Application 201210004625.6, dated Feb. 26, 2018 (10 pages).
Response to Office Action dated Dec. 2, 2016 in Chinese Patent Application No. 201210004625.6 (English translation of claim amendments only).

(56) References Cited

OTHER PUBLICATIONS

Office Action dated Dec. 11, 2017 in Canadian Patent Application No. 2,762,259.

* cited by examiner

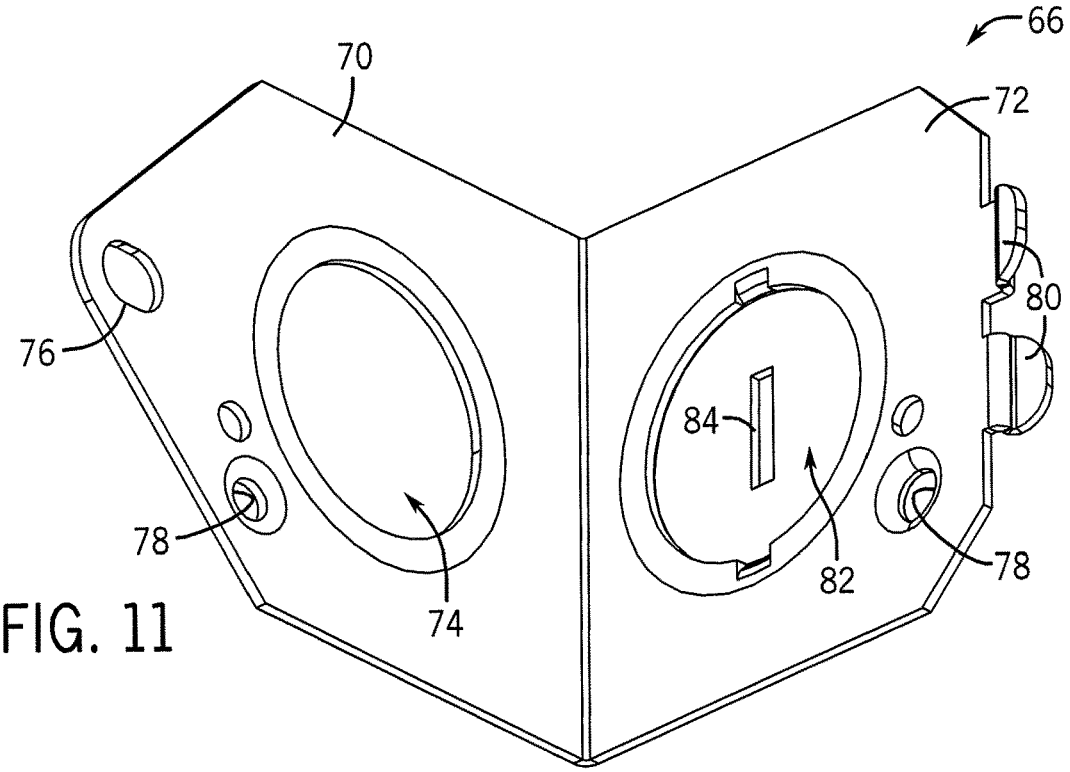
FIG. 11
FIG. 12A
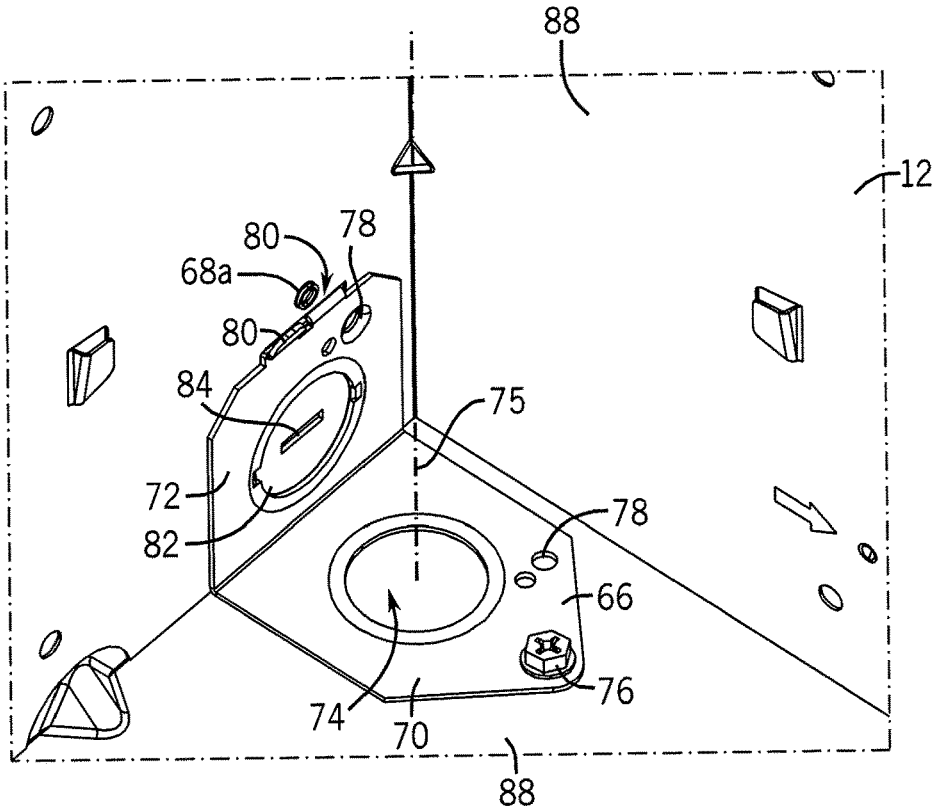

VENTILATING SYSTEM AND METHOD

BACKGROUND

Conventional lighting and ventilating systems can combine elements of a conventional room ventilating fan with a light fixture. These apparatuses can have a bulky, unaesthetic appearance, can employ a complicated design, can fail to adequately cool the light fixture, and can inefficiently arrange the components of the apparatus. Additionally, many conventional lighting and ventilating systems can include only limited capabilities for installation into structures, such as a building.

SUMMARY

Some embodiments of the invention provide a ventilating system including a housing. In some embodiments, the housing can include an inlet through which air can be received within the housing and an outlet through which air can exit the housing. In some embodiments, the housing can include an inner surface, an outer surface, and an electrical aperture. In some embodiments, a fan can be supported in the housing. The fan can be operable to generate a flow of air. In some embodiments, a panel can be coupled to the housing substantially immediately adjacent to the electrical aperture. In some embodiments, the panel can comprise at least one clamp aperture and can be configured and arranged to be coupled to at least one of the inner surface and the outer surface. In some embodiments, the panel can also be configured and arranged so that at least one clamp aperture can be disposed in one of a first position and a second position.

Some embodiments of the invention provide a ventilating system including a housing. In some embodiments, the housing can include an inlet through which air can be received within the housing and an outlet through which air can exit the housing. In some embodiments, the housing can include an inner surface, an outer surface, and an outlet aperture disposed substantially adjacent to the outlet. In some embodiments, a fan can be supported in the housing. The fan can be operable to generate a flow of air. In some embodiments, a grille can be operatively coupled to a portion of the housing. In some embodiments, a duct connection assembly can be coupled to the housing substantially adjacent to the outlet. In some embodiments, the duct connector assembly can comprise a base region and a connection region. In some embodiments, the base region can include at least one flange including a flange aperture. In some embodiments, the duct connector assembly can be configured and arranged so that at least a portion of the flange can be disposed immediately adjacent to at least one of the inner surface and the outer surface so that the flange aperture can be substantially aligned with at least one outlet aperture.

DESCRIPTION OF THE DRAWINGS

FIG. 11 is a perspective view of a panel according to one embodiment of the invention.

FIG. 12A is a perspective view of a panel coupled to a housing according to one embodiment of the invention.

DETAILED DESCRIPTION

Figure 1:
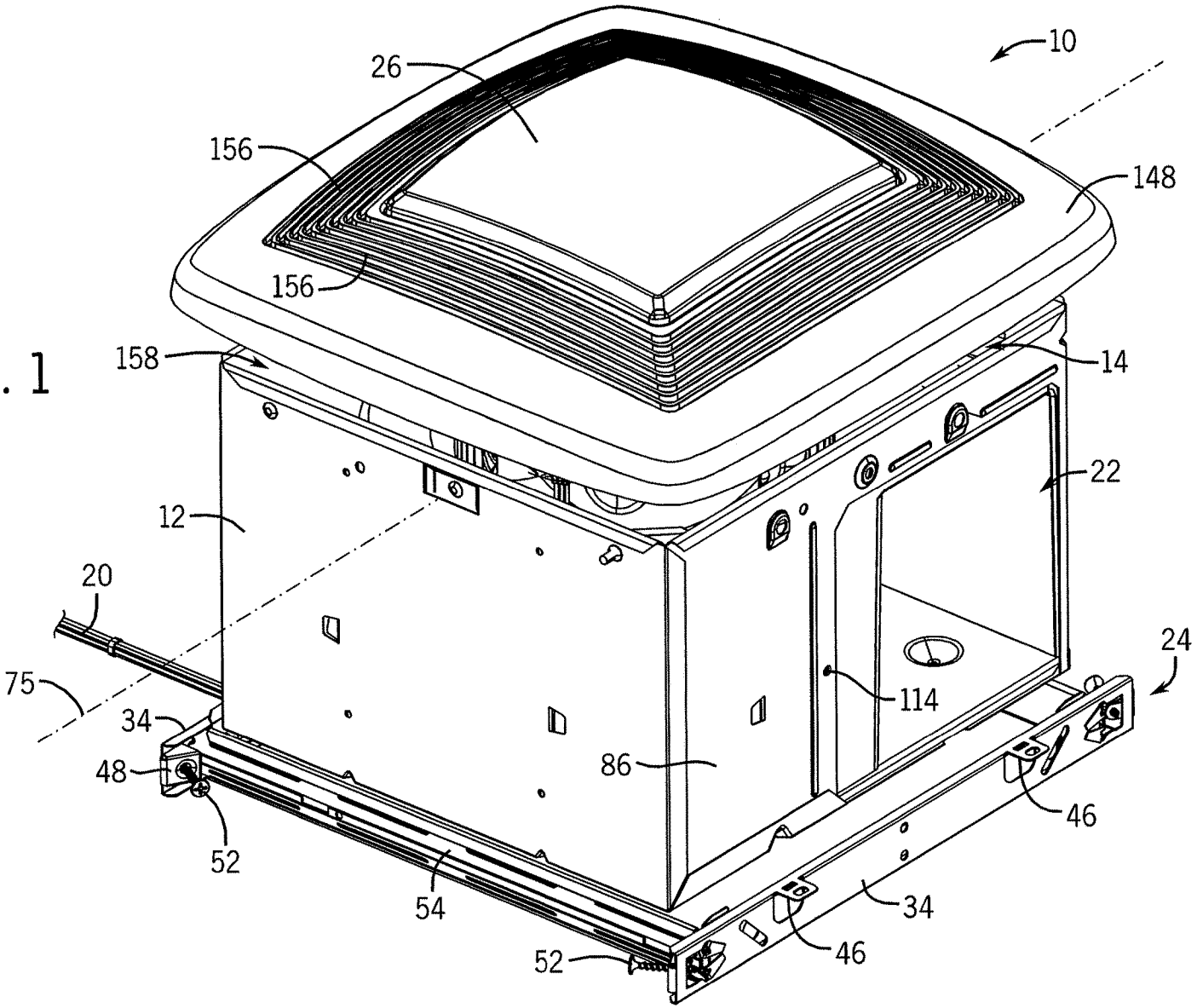
FIG. 1 is a perspective view of a ventilating system according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives that fall within the scope of embodiments of the invention.

FIG. 1 illustrates a ventilating system 10 according to one embodiment of the invention. Some embodiments of the system 10 can include several components and devices that can perform various functions. In some embodiments of the present invention, the system 10 can include a housing 12, which can be configured and arranged to receive components of the system 10. The system 10 generally can include a ventilating assembly 14, a lamp housing 16, at least one illumination device 18, electrical connections 20, a ventilation outlet 22, at least one mounting apparatus 24 which can be used to mount the ventilating system 10 to a surface or a support structure, a lens 26, a motor 28, and at least one electrical socket 30.

In some embodiments, the system 10 can be used to illuminate and/or ventilate any room, area, or space. In some embodiments, the system 10 can illuminate the room, area, or space independently of ventilating the room, area, or space. Moreover, in some embodiments, the system 10 can be configured and arranged to substantially only ventilate the room, area or space. In other embodiments, the system 10 can be configured and arranged to substantially only illuminate the room, area or space.

As shown in FIG. 1, in some embodiments, the housing 12 can comprise any material which can withstand varying temperatures (e.g., to withstand any heat radiated and/or conducted from the illumination devices, the motor, or other components) while providing structural support to the system 10. In some embodiments, the housing 12 can be formed of sheet metal; however, the housing 12 also can be fabricated from ceramic or a polymer comprising a relatively high melting temperature. The housing 12 can be formed into any shape, including, but not limited to, a rectangular box-like shape, an oval shape, a hemispherical shape, a spherical shape, a pyramidal shape, or any other shape. The housing 12 can faun a base or a similar support structure of the system 10. Further, in some embodiments, the housing 12 can provide points and areas of attachment for other components of the system 10, as described in further detail below.

As shown in FIG. 1, in some embodiments, the housing 12 can be used in conjunction with a mounting apparatus 24 for installing the system 10 to any variety of support structures or surfaces. Any type of mounting apparatus 24 can be included with the housing 12. The mounting apparatus 24 can be positioned on the housing 12 so that the housing 12 can be supported with respect to any surrounding structure into which it can be installed. In other embodiments, the housing 12 can be coupled to a support structure or a surface using a variety of fasteners and coupling methods, as described below.

In some embodiments, the mounting apparatus 24 can comprise at least one first mounting bracket 32, at least one second mounting bracket 34, and at least one third mounting bracket 36. For example, in some embodiments, the mounting apparatus 24 can comprise two first mounting brackets 32, two second mounting brackets 34, and two third mounting brackets 36, as shown in FIG. 2. In some embodiments, the first mounting brackets 32 and the third mounting brackets 36 can be configured and arranged to couple the housing 12 to the mounting apparatus 24 and the second mounting brackets 34 can be configured and arranged to couple the mounting apparatus 24 to a structure (e.g., a portion of a building such as a joist). In some embodiments, the second mounting brackets 34 can be substantially perpendicular to the third mounting brackets 36.

In some embodiments, at least a portion of the housing 12 can be coupled to the mounting apparatus 24 via the first and third mounting brackets 32, 36. In some embodiments, the first mounting brackets 32 can each include at least one lead-in feature 38 that can be configured and arranged to at least partially guide and retain a portion of the housing 12 in place substantially adjacent to the first and the third mounting brackets 32, 36. The at least one lead-in feature 38 can comprise an alignment plate 38*a* configured to be parallel to the housing 12 and at least one guiding plate 38*b* extending from the alignment plate 38*a* at an angle to the alignment plate 38*a* as depicted, for example, in FIG. 6. For example, in some embodiments, the first mounting brackets 32 can be coupled to the mounting apparatus 24 so that they are spaced apart by a distance substantially similar to the width and/or length of the housing 12 so that opposing sides of the housing 12 can be substantially immediately adjacent to the first mounting brackets 32, as shown in FIGS. 2 and 3. Moreover, in some embodiments, the first mounting brackets 32 can each comprise two lead-in features 38 disposed so that the lead-in features 38 are substantially adjacent to corners of the housing 12 and configured to be substantially immediately adjacent to the housing 12. The portions of the first mounting brackets 32 extending between the two lead-in features 38 can be configured to be spaced from the outer surface of the housing 12 to define a clearance portion of the first mounting brackets 32 as depicted, for example, in FIG.

6. For example, in some embodiments, the mounting apparatus 24 can comprise four lead-in features 38 substantially adjacent to four corners of the housing 12.

Figure 3A:
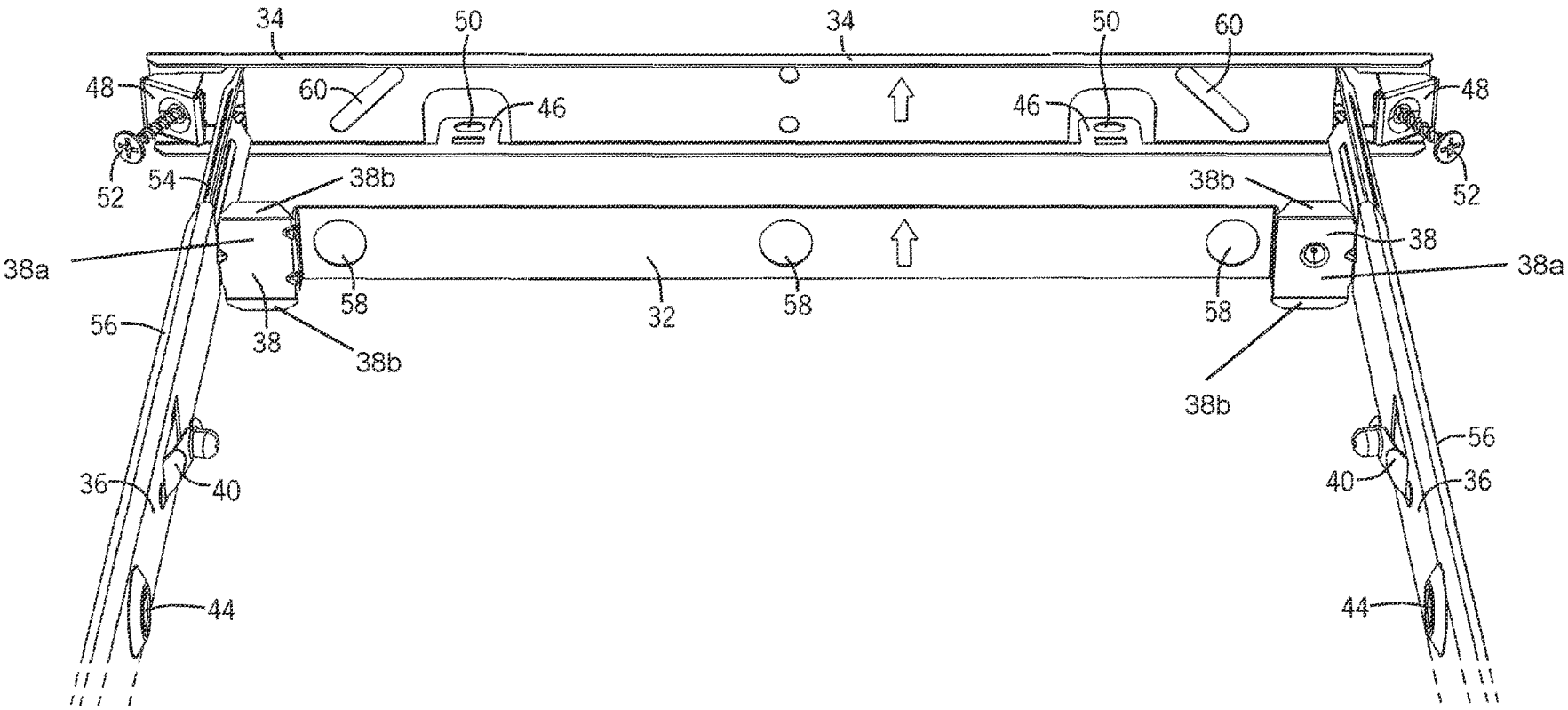
FIG. 3A is a perspective view of a portion of the mounting apparatus of FIG. 2.

Furthermore, as shown in FIG. 3A, in some embodiments, at least a portion of the lead-in features 38 can be disposed substantially between the first and the third mounting brackets 32, 36. For example, in some embodiments comprising a substantially square-shaped housing 12, the first and the third mounting brackets 32, 36 can be coupled together so that they form a substantially square-shaped, generally central portion of the mounting apparatus 24. Furthermore, the first and third mounting brackets 32, 36 can be disposed in the mounting apparatus 24 so the first mounting brackets 32 are on substantially opposite sides of the housing 12, as are the third brackets 36. As a result, the lead-in features 38 can be disposed substantially in the corners of a portion of the mounting apparatus 24 and substantially immediately adjacent to corners of the housing 12 for use in positioning and coupling the mounting apparatus 24 to the housing 12.

Figure 4A:
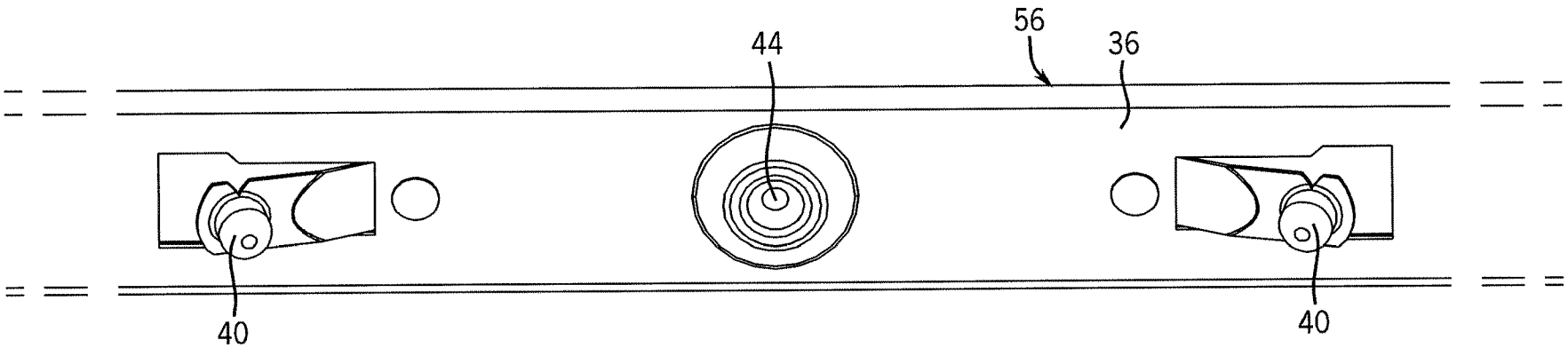
FIG. 4A is a front view of a bracket of the mounting apparatus of FIG. 2.
Figure 4B:
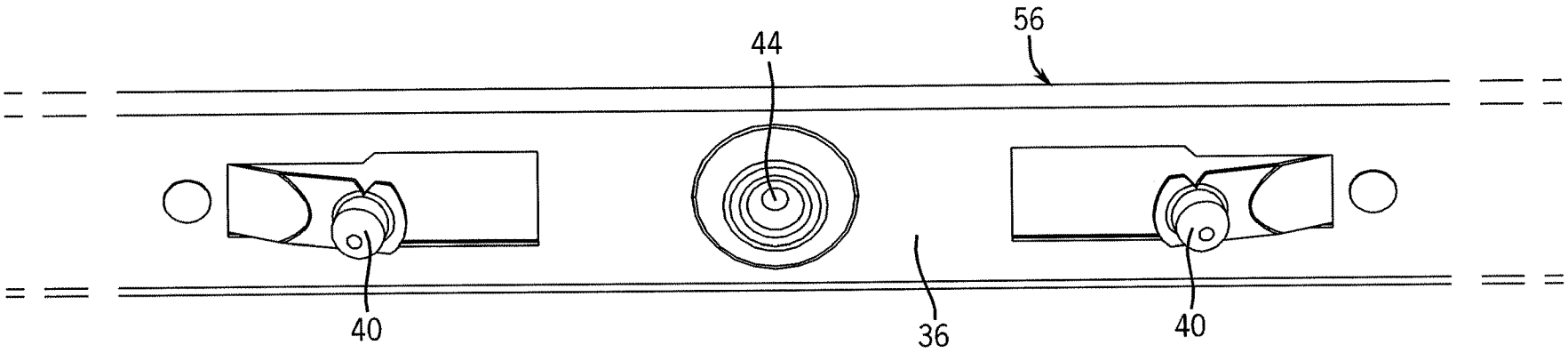
FIG. 4B is a front view of a bracket according to one embodiment of the invention.
Figure 5:
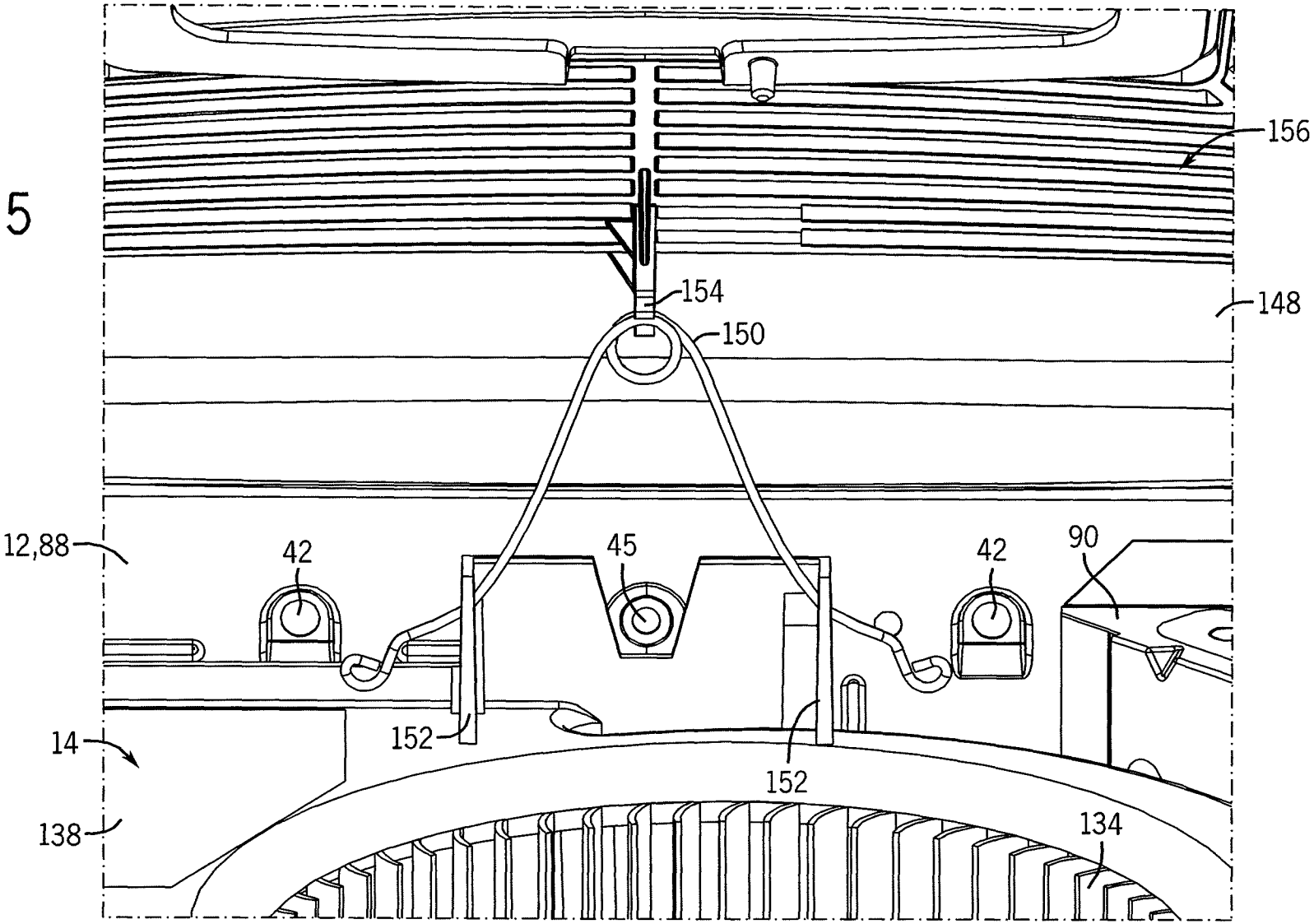
FIG. 5 is an expanded perspective view of a grille, housing, and ventilating assembly according to one embodiment of the invention.

In some embodiments, the third mounting brackets 36 can comprise features configured and arranged to further aid in coupling the housing 12 to the mounting apparatus 24, as shown in FIGS. 4A and 4B. In some embodiments, the third brackets 36 can comprise at least one snap-fit element 40 positioned to align with at least one first aperture 42 on the housing 12. For example, in some embodiments, each of the third brackets 36 can comprise two snap-fit elements 40 (e.g., snap-fit and/or spring-loaded protrusions, buttons, or other retaining features) configured and arranged to engage two first apertures 42 disposed through portions of the housing 12. In some embodiments, when the housing 12 is positioned substantially within the first and the third brackets 32, 36, the lead-in features 38 can, at least partially guide the housing 12 into position where the snap-fit elements 40 can engage the first apertures 42 disposed through the housing 12. Although referred to as snap-fit elements 40, in some embodiments, these features can comprise other structures capable of engaging the first apertures 42 (e.g., not spring-loaded or snap-fit). Accordingly, once in position, the snap-fit elements 40 can substantially automatically engage the first apertures 42 when the apertures 42 are immediately adjacent to the elements 40. Moreover, in some embodiments, at least one of the third brackets 36 can comprise at least one mounting aperture 44 and the housing 12 can comprise at least one second aperture 45 so that a conventional fastener (e.g., a screw, a nail, etc.) can be used in lieu of or together with at least one of the snap-fit elements 40. In some embodiments, one or more of the third brackets 36 can comprise mounting apertures 44 (e.g., disposed substantially between the snap-fit elements 40) so that sides of the housing 12 immediately adjacent to the third brackets 36 can be coupled to the mounting apparatus 24 in multiple manners, as shown in FIGS. 4 and 5. For example, in some embodiments, the housing 12 can be positioned with respect to the mounting apparatus 24 via the first mounting brackets 32 (e.g., via the lead-in features 38) and the third mounting brackets 36 (e.g., via the snap-fit elements 40 and/or the mounting apertures 44).

In some embodiments, as shown in FIG. 4B, the third mounting brackets 36 can comprise alternative configurations. As shown in FIG. 4B, one or more of the third brackets 36 can comprise the snap-fit elements 40 disposed in different locations. For example, relative to FIG. 4A, one or more of the snap-fit elements 40 can be rotated approximately 180 degrees, which can enable the manufacturer or user to position additional elements or details coupled to or disposed through portions of the third mounting brackets 36.

In some embodiments, the second brackets 34 can at least partially enable coupling of the mounting apparatus 24 to a structure. In some embodiments, the system 10 can be at least partially installed in a building for use in lighting and/or ventilating areas of the building (e.g., a bathroom, a bedroom, a kitchen, etc.). By way of example only, in some embodiments, the system 10 can be coupled to building support structures (e.g., joists, trusses, etc.) for support, positioning, and relative ease in accessing the building's ventilation system (e.g., ducts or vents to the environment). Accordingly, in some embodiments, the second brackets 34 can at least partially enable coupling to the building support structures.

Figure 6:
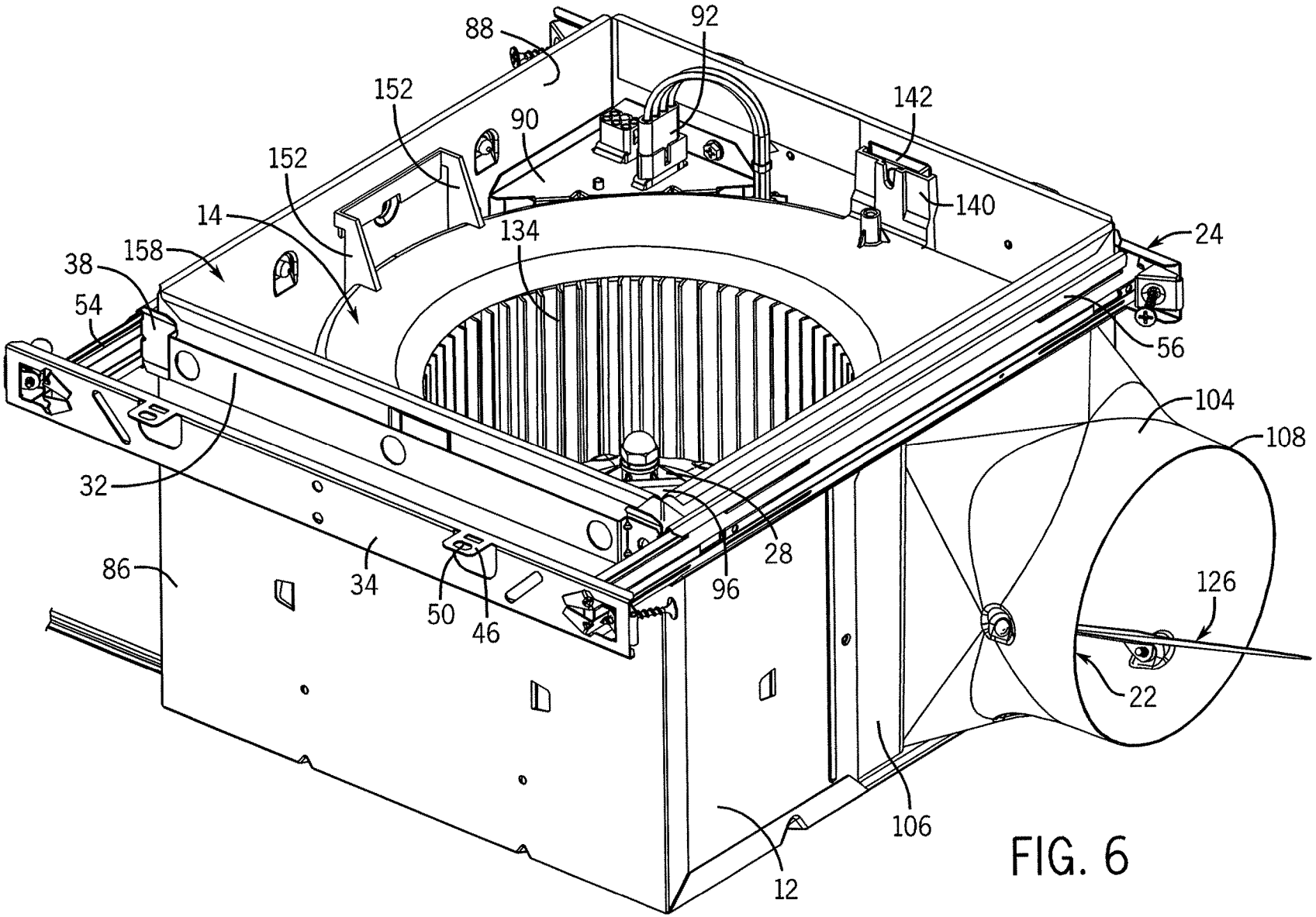
FIG. 6 is a perspective view of a portion of a ventilating system according to one embodiment of the invention.
Figure 7:
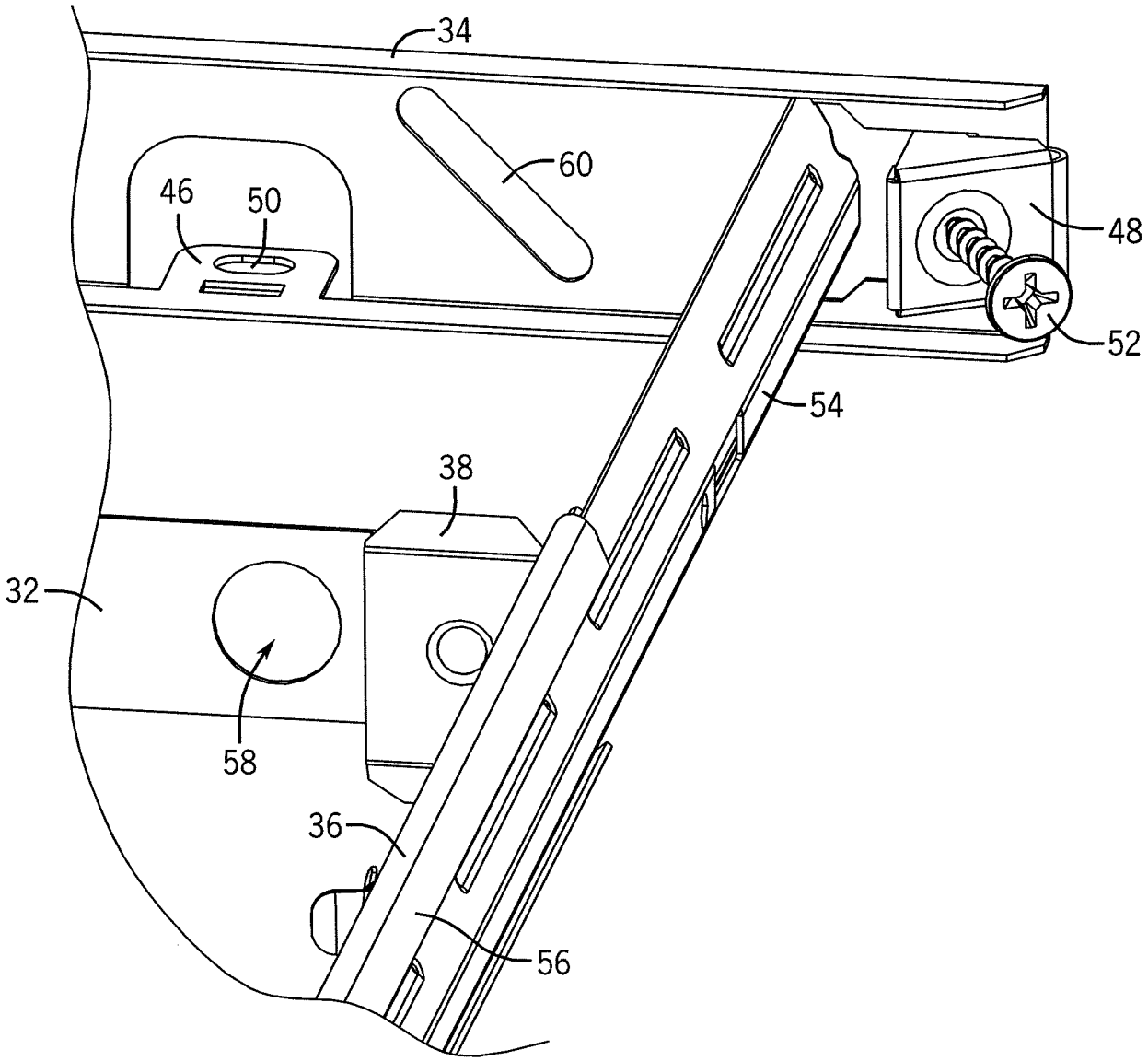
FIG. 7 is an expanded perspective view of a portion of the mounting apparatus of FIG. 2.

In some embodiments, the second brackets 34 can comprise elements for mounting the system 10 to and/or within a building. In some embodiments, the second brackets 34 can comprise at least one tab 46 and at least one coupling structure 48. For example, as shown in FIGS. 6 and 7, in some embodiments, the mounting apparatus 24 can comprise two second brackets 34 and each of the second brackets 34 can comprise two tabs 46 (i.e., four total) and two coupling structures 48 (i.e., four total). In some embodiments, the tabs 46 can at least partially laterally extend from the second brackets 36 and can enable positioning of the mounting apparatus 24 with respect to the building structure. Moreover, in some embodiments, at least some of the tabs 46 can comprise a tab aperture 50 disposed through a portion of the tabs 46 that can receive a conventional fastener (e.g., a screw, a nail, etc.) or other coupling apparatus. As a result, when disposing the system 10 within the building structure, at least a portion of the tabs 46 can function to align the mounting apparatus 24 with portions of the building structure, and in some embodiments, at least a portion of the tabs 46 can receive fasteners via the tab apertures 50 to further coupling of the system 10 to the building.

In some embodiments, the coupling structures 48 can further enhance installation of the system 10. In some embodiments, the coupling structures 48 can comprise a conventional fastener 52 coupled to the second brackets 34. For example, as shown in FIGS. 6 and 7, in some embodiments, the coupling structures 48 can be substantially positioned at corners of the mounting apparatus 24 so that after aligning the mounting apparatus 24 using the tabs 46, the conventional fasteners 52 of the coupling structures 48 can be used to couple the system 10 to the building structure (e.g., by engaging the fasteners with the building structure). By way of example only, in some embodiments, the coupling structures 48 can comprise the conventional fasteners 52 (e.g., screws, as shown in FIG. 7) pre-disposed through a portion of the second brackets 34 and positioned at an angle (e.g., 30 degrees, 45 degrees, 60 degrees, 90 degrees, etc.) for ease of engaging the fasteners 52 with the building structure. In some embodiments, by including pre-disposed (e.g., permanently or temporarily affixed to the coupling structures 48) conventional fasteners 52, installation can be made more simple because the installer need not keep track of, and position, the fasteners 52 during installation.

In some embodiments, the mounting apparatus 24 can comprise at least one support member 54. In some embodiments, the mounting apparatus 24 can comprise two or more support members 54 (e.g., four support members 54). In some embodiments, the support members 54 can extend from one second bracket 34 to another second bracket 34 (e.g., some or all of a length of the mounting apparatus 24). For example, as shown in FIGS. 2A, 2B, 3A, 3B and 7, in some embodiments the support members 54 can be coupled to the second brackets 34 substantially adjacent to the coupling structures 48 (e.g., adjacent to the corners of the mounting apparatus 24) and can be at least partially received by flanges 56 of the third brackets 36. In the depicted embodiments, a flange 56 extends along an upper edge of each third bracket 36 around an upper edge of the support members 54 and, separately, a flange 56 extends along a lower edge of each third bracket 36 around a lower edge of the support members 54. As a result, in some embodiments, the support members 54 and the second brackets 34 can at least partially define a perimeter of the mounting apparatus 24.

Figure 27:
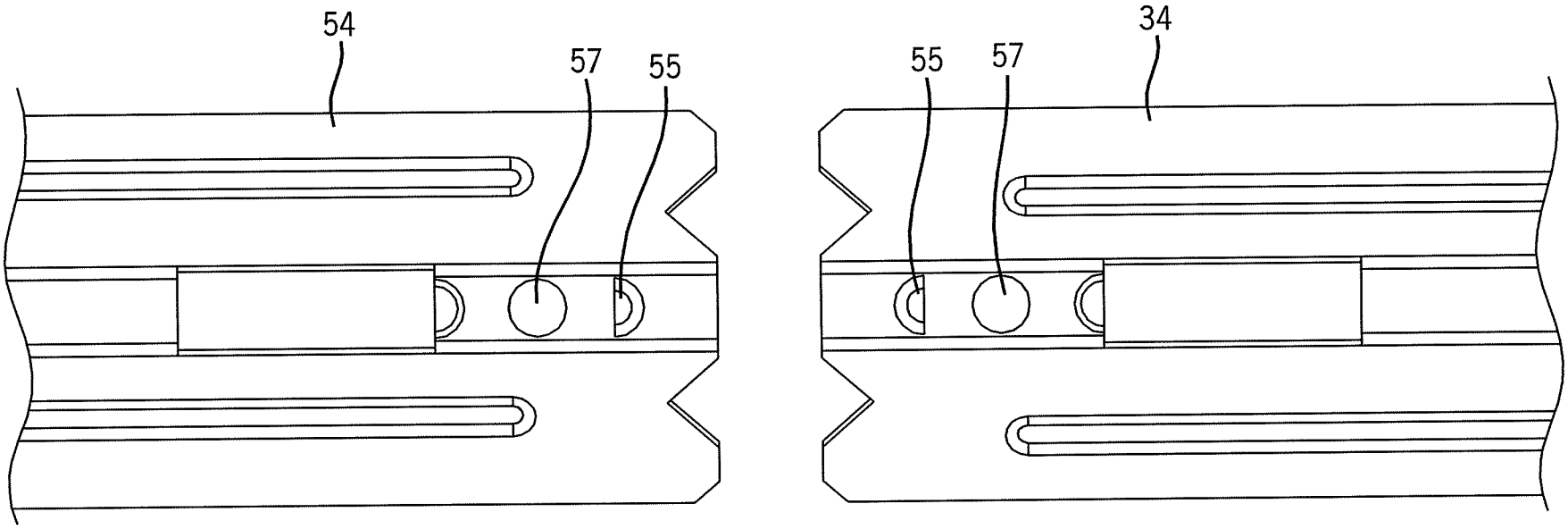
FIG. 27 is a front view of brackets according to one embodiment of the invention.

For example, as shown in FIG. 27, at least a portion of the support members 54 can be coupled to the second mounting bracket 34. In some embodiments, lateral edges of at least a portion of the support members 54 and the second mounting brackets 34 can comprise coupling structures. As shown in FIG. 27, in some embodiments, at least some of the support members 54 and the second mounting brackets 34 can comprise at least one tab 55 and at least one aperture 57. For example, in some embodiments, the support member 54 can engage (e.g., slidably engage) the second mounting bracket 34 so that the aperture 57 of the second mounting bracket 34 can at least partially receive a portion of the tab 55 of the support member 54 or vice versa (e.g., the aperture 57 of the support member 54 can at least partially receive the tab 55 of the second mounting bracket 32). The interaction of the tab 55 and aperture 57 can at least partially support the engagement and coupling of the support members 54 and the second mounting brackets 34.

Figure 2A:
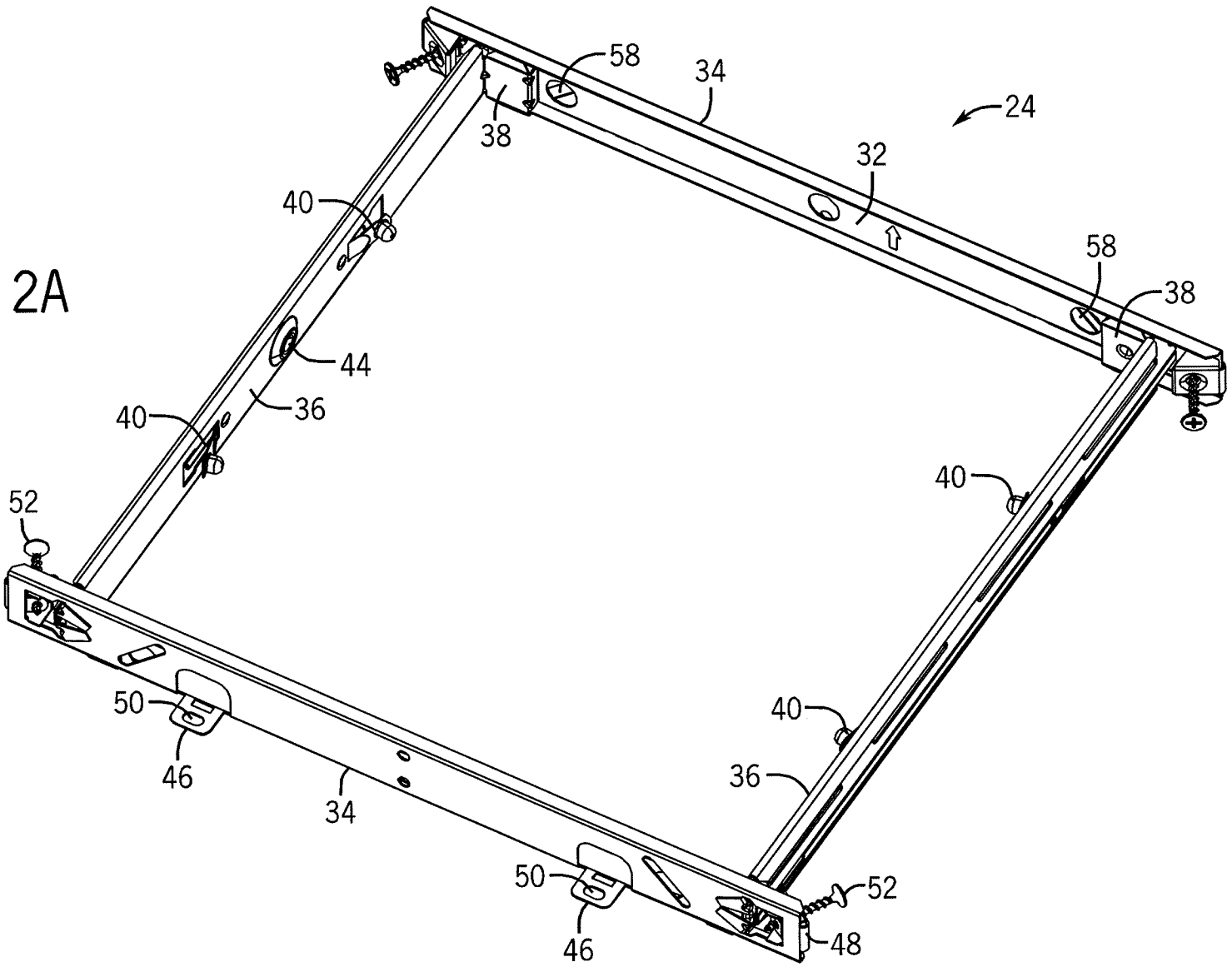
FIGS. 2A and 2B are perspective views of a mounting apparatus according to one embodiment of the invention.
Figure 2B:
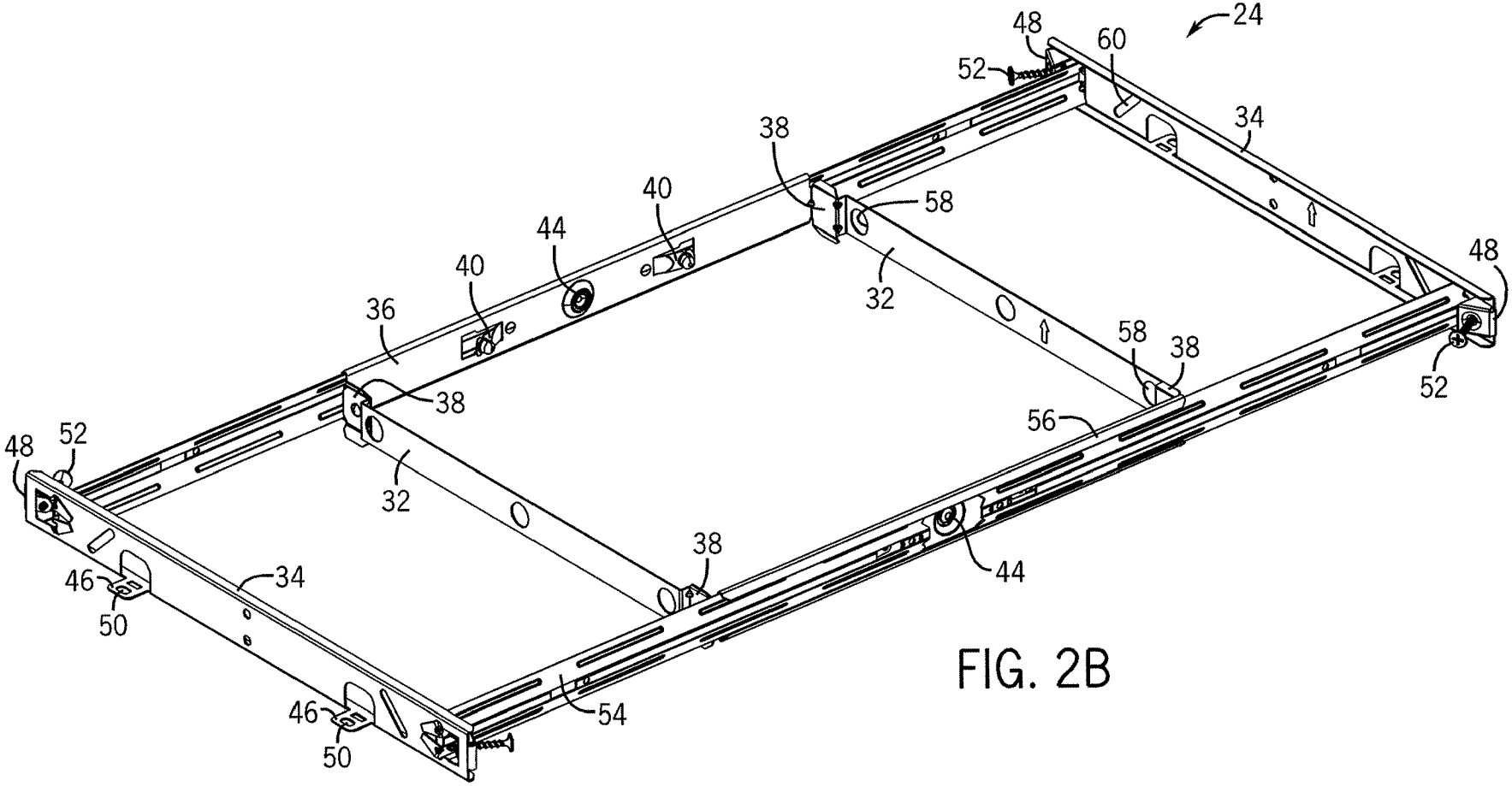

In some embodiments, the support members 54 can be configured and arranged to fit multiple building structures. As shown in FIGS. 2A and 2B, in some embodiments, the support members 54 can comprise an expandable functionality. For example, in some embodiments, as shown in FIG. 2A, the support members 54 can comprise a substantially retracted configuration so that the first brackets 32 and the second brackets 34 are substantially immediately adjacent. Moreover, as shown in FIG. 2B, in some embodiments, the support members 54 can comprise a substantially extended configuration so that the first brackets 32 and the second brackets 34 are spaced apart a distance correlating to the distance that the support members 54 extend. As a result, in some embodiments, a single mounting apparatus 24 can be coupled to building structures comprising different configurations. For example, a manufacturer can manufacture systems 10 that can be installed in buildings with joists disposed approximately sixteen inches apart, twenty-four inches apart, and/or any other desired distance.

As a result of at least a portion of the elements of the mounting apparatus 24, the system 10 can be installed within a building structure. Briefly, in some embodiments, the housing 12 can be coupled to the mounting apparatus 24 via elements of the third brackets 36 (e.g., snap-fit elements 40, mounting apertures 44, etc.) and the first brackets 32 (e.g., the lead-in features 38). In some embodiments, after coupling the housing 12 to the mounting apparatus 24, the system 10 can be coupled to the building structure. For example, in some embodiments, the mounting apparatus 24 can be at least partially aligned via the tabs 46 and coupled to the building using the coupling structures 48 and fasteners 52. Moreover, in some embodiments, one of the second brackets 34 can be coupled to a portion of the building structure (e.g., a joist) and the support members 54 can be extended a necessary distance to reach an adjacent building structure (e.g., another joist). Accordingly, after extending the support members 54, another of the second brackets 34 can be coupled to the adjacent building structure in a similar manner. In other embodiments, the mounting apparatus 24 can be coupled to the building structure and then the housing 12 can be coupled to the mounting apparatus 24.

In some embodiments, the previously mentioned installation procedure can be employed when installing the system 10 within a building structure that is at least partially unfinished. For example, in some embodiments, the system 10 can be installed prior to installation of a ceiling or other similar building features. As a result, the system 10 can be simply installed because of the generally free access available to trusses, joists, etc. However, in some embodiments, the system 10 can be configured and arranged to be installed within a building structure that is already substantially completed (e.g., a retrofit installation).

In some embodiments, when the building structure is already substantially completed, the first and the second brackets 32, 34 can comprise additional features capable of coupling the housing 12 to the mounting apparatus 24. For example, as shown in FIG. 7, in some embodiments, the first brackets 32 can comprise at least one access aperture 58 and the second brackets 34 can comprise at least one alternative mounting aperture 60. Moreover, in some embodiments, at least a portion of the tabs 46 can be reconfigured. For example, in some embodiments, the tabs 46 can be moved (e.g., bent, pushed, pulled, etc.) so that the tabs 46 no longer laterally extend from the second brackets 34 but are substantially flush with the second brackets 34 (e.g., the tabs 46 can be moved from a substantially horizontal position to a substantially vertical position).

Figure 3B:
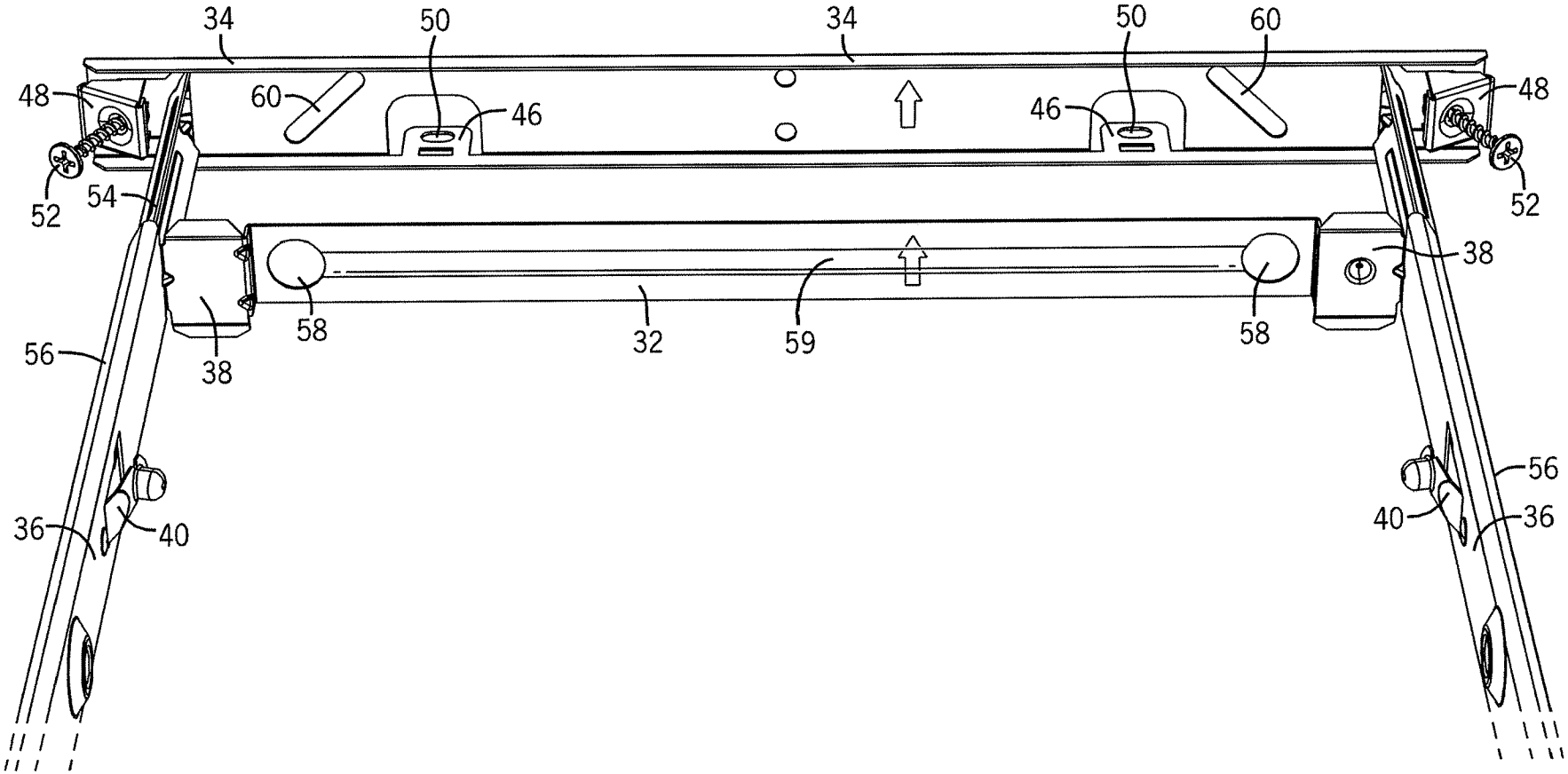
FIG. 3B is a perspective view of a mounting apparatus according to one embodiment of the invention.

As shown in FIG. 3B, in some embodiments, the first mounting brackets 32 can comprise few numbers of access apertures 58. For example, as shown in FIG. 3B, one or more of the first mounting brackets 32 can comprise two access apertures 58. As a result, in some embodiments, the structural strength of the mounting brackets 32 can be increased because of the greater amounts of materials present, relative to embodiments with more than two access apertures 58. Moreover, in some embodiments, one or more of the first mounting brackets 32 can comprise a rib 59. For example, as shown in FIG. 3B, the rib 59 can extend some or all of a lateral distance of the first mounting bracket 32 to enhance structural strength of the bracket 32 relative to some embodiments without the rib 59.

Accordingly, in some embodiments, the mounting apparatus 24 can be configured to enable a retrofit installation. By way of example only, in some embodiments, after removing a previous lighting and/or ventilating system, the mounting apparatus 24 can be affixed to the building structures. For example, in some embodiments, because the tabs 46 can comprise a substantially vertical position after reconfiguration, one of the second brackets 34 can be positioned substantially adjacent to one of the building structures. In some embodiments, fasteners can be used to couple the mounting apparatus 24 to the building structure by inserting the fasteners through at least one of the alternative mounting apertures 60 and the tab apertures 50 (e.g., an user/installer can access the alternative mounting apertures 60 via the access apertures 58). Then, in some embodiments, the support members 54 can be extended similar to some previously mentioned embodiments until the opposing second bracket 34 contacts an adjacent building structure and the mounting apparatus 24 can be coupled to the adjacent building structure in a substantially similar fashion. After securing the mounting apparatus 24, in some embodiments, the housing 12 can be coupled to the mounting apparatus 24 in a substantially similar fashion to some previously mentioned embodiments (e.g. via the first and the third brackets 32, 36).

Figure 8:
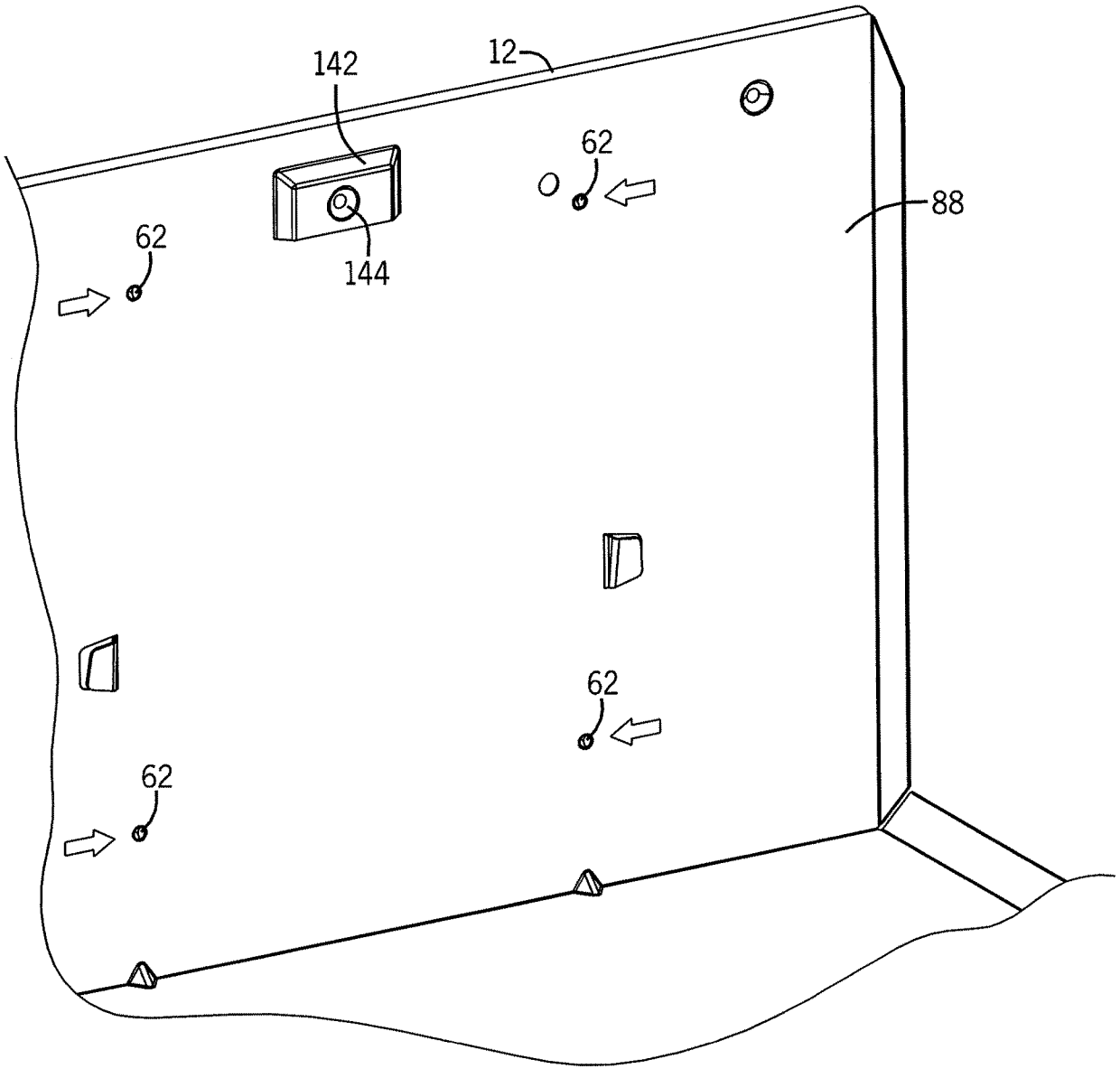
FIG. 8 is a side view of a portion of a housing according to one embodiment of the invention.

In some embodiments, the housing 12 can be coupled to the building structure without the mounting apparatus 24. In some embodiments, the housing 12 can comprise a plurality of dimples 62, as shown in FIG. 8. In some embodiments, the housing 12 can comprise four dimples 62 on two substantially opposing sides that are disposed substantially adjacent to the build structures. In some embodiments, the dimples 62 can comprise pre-stressed regions of the housing 12. For example, in some embodiments, the dimples 62 can function to enable a user/installer to more easily drive fasteners (e.g., screws, nails, bolts, etc.) through the housing 12 and into the building structure because the tip of the fastener will not wander out of the dimples 62. Moreover, because the dimples 62 are pre-stressed regions, it may be at least partially easier to drive the fasteners through the dimples 62 relative to driving fasteners through other regions of the housing 12.

As shown in FIG. 8, in some embodiments, the housing 12 can comprise indicators 63 to aid the user in identifying the location of the dimples 62. For example, as shown in FIG. 8, the indicators 63 can be configured as arrows pointed toward some or all of the dimples 62 and can be positioned substantially adjacent to the dimples 62 for easy dimple 62 identification. In some embodiments, as shown in FIG. 8, the indicators 63 can be positioned between the dimples 62 and adjacent walls of the housing 12. In some embodiments, the indicators 63 can be positioned substantially between the dimples 62 and the receiving member 142 (not shown). In other embodiments, the indicators 63 can be positioned in any of a variety of locations to identify the dimples 62.

Figure 9:
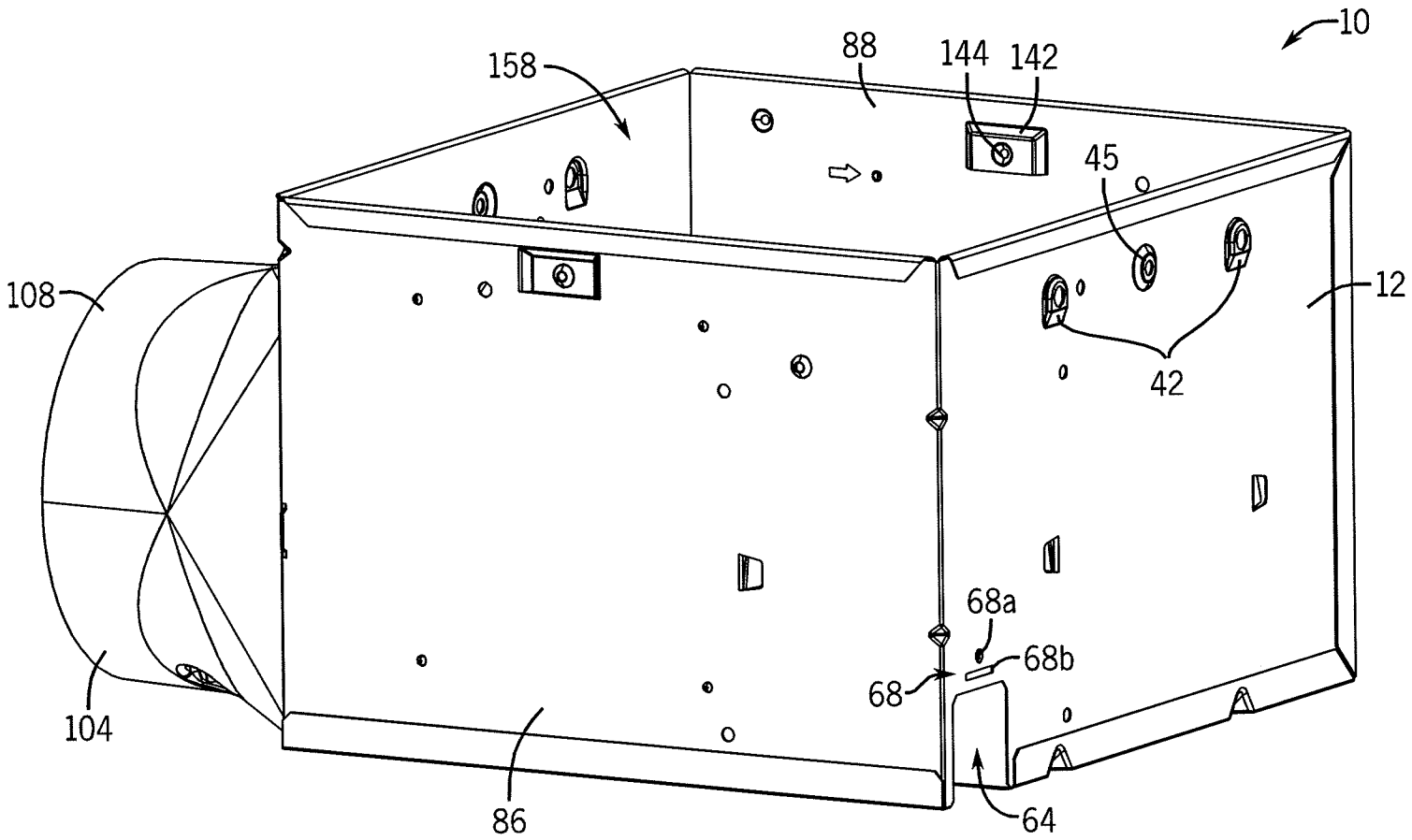
FIG. 9 is a perspective view of a portion of a housing according to one embodiment of the invention.
Figure 10:
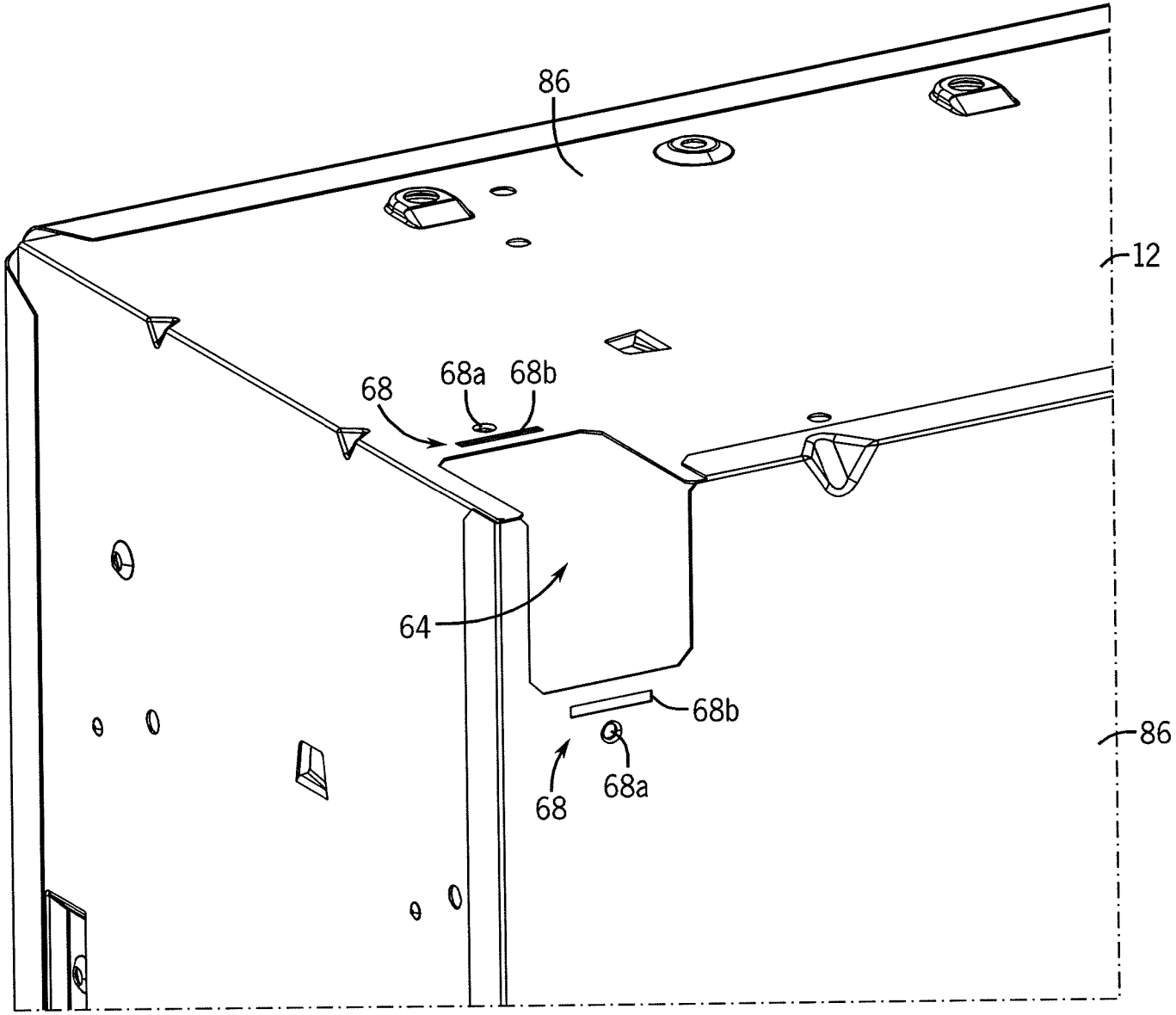
FIG. 10 is an expanded perspective view of a portion of a housing according to one embodiment of the invention.

In some embodiments, multiple elements of the system 10 can be disposed within and/or coupled to the housing 12. For example, in some embodiments, the electrical connections 20 of the system 10 can be at least partially positioned through portions of the housing 12. In some embodiments, the housing 12 can comprise an electrical aperture 64 configured and arranged to receive a panel 66, which can be configured and arranged to at least partially receive and support the electrical connections 20. As shown in FIG. 9, in some embodiments, an area substantially adjacent to a lower region (e.g., a lower corner) of the housing 12 can comprise the electrical aperture 64. In other embodiments, the electrical aperture 64 can be disposed in other locations that can enable electrical connections 20 to couple to elements of the system 10. Moreover, in some embodiments, the electrical aperture 64 can be dimensioned to receive at least a portion of the panel 66. Additionally, in some embodiments, the housing 12 can comprise features 68 configured and arranged to couple the panel 66 to the housing 12. For example, in some embodiments, as shown in FIG. 10, the features 68 can comprise two sets of substantially identical apertures adjacently disposed at lateral edges of the electrical aperture 64. In some embodiments, the features 68 can be configured and arranged to receive different elements, as shown in FIG. 10. For example, in some embodiments, a first aperture 68*a* of each of the sets can comprise a substantially annular configuration and a second aperture 68*b* of each of the sets can comprise a substantially elongated and/or oblong configuration to receive different elements. Furthermore, as detailed in greater detail below, by including substantially identical apertures 68*a*, 68*b* adjacent to edges of the electrical aperture 64, the panel 66 can be coupled to the housing 12 in multiple configurations.

In some embodiments, the panel 66 can comprise a first body 70 and a second body 72, as shown in FIG. 11. In some embodiments, the first body 70 can be coupled to the second body 72 so that the bodies 70, 72 are substantially perpendicular to each other. In some embodiments, the bodies 70, 72 can be substantially integral with each other so that the panel 66 comprises a substantially planar body 70 that can receive a force (e.g., bent, pushed, pulled, etc.) to configure the panel 66 in a substantially perpendicular configuration (e.g., an "L-shaped" configuration). For example, in some embodiments, the first body 70 can be oriented approximately ninety degrees from the second body 72.

In some embodiments, the first body 70 and the second body 72 can comprise different configurations. In other embodiments, the first body 70 and the second body 72 can comprise a substantially similar configuration. In some embodiments, the first body 70 can comprise at least one clamp aperture 74, at least one panel aperture 76, and grounding apertures 78. For example, as shown in FIG. 11, in some embodiments, the clamp aperture 74 can be disposed through the first body 70 in a generally central location and can be configured and arranged to receive and support at least a portion of the electrical connections 20. Moreover, in some embodiments, the grounding apertures 78 can be disposed substantially adjacent to the clamp aperture 74 and can be dimensioned to receive a ground screw (not shown) and wiring for use in grounding the electrical connections 20 and electricity-requiring components of the system 10 (e.g., the ventilating assembly 14). Furthermore, in some embodiments, the panel aperture 76 can be disposed through a portion of the first body 70 at a point substantially distal from the second body 72. Additionally, in some embodiments, a region of the first body 70 substantially adjacent to the panel aperture 76 can comprise a reduced width and/or length relative to other portions of the first body 70 (e.g., the region adjacent to the panel aperture 76 can comprise a substantially angled or pointed configuration, as shown in FIG. 11).

In some embodiments, the second body 72 can comprise similar and different elements. As shown in FIG. 11, in some embodiments, the second body 72 can comprise grounding apertures 78, positioning flanges 80, and a knock-out region 82. In some embodiments, the knock-out region 82 can comprise pre-cut or pre-distressed elements that can enable a user to remove the knock-out region 82 so that the second body 72 can comprise a clamp aperture 74 substantially similar to the clamp aperture 74 of the first body 70. For example, in some embodiments, portions of a perimeter of the knock-out region 82 can comprise a reduced thickness relative to a thickness of the second body 72 and the knock-out region 82 can comprise a substantially centrally located knock-out aperture 84. In some embodiments, a user can insert a device (e.g., a screwdriver) within the knock-out aperture 84 to exert a force that can at least partially displace and help remove the knock-out region 82 to form a clamp aperture 74. Further, in some embodiments, the positioning flanges 80 can extend from the second body 72 and can be positioned so that they are substantially perpendicular to the second body 72 and substantially parallel to the first body 70. Moreover, in some embodiments, the positioning flanges 80 can extend in substantially opposite directions. For example, in some embodiments, relative to a horizontal axis of the second body 72, one positioning flange 80 can extend above the horizontal axis of the second body 72 and another positioning flange 80 can extend below the horizontal axis of the second body 72.

In some embodiments, the positioning flanges 80 and the panel aperture 76 can provide for coupling of the panel 66 to the housing 12. As shown in FIGS. 12A-12D, in some embodiments, at least one of the flanges 80 can be disposed through one of the features 68 of the housing 12. For example, in some embodiments, one of the flanges 80 can be inserted through one of the features 68 (e.g., second aperture 68*b*), which can at least partially provide for positioning of the panel 66 with respect to the electrical aperture 64 (e.g., disposing the panel 66 over at least a portion of the aperture 64). Moreover, in some embodiments, before and/or after disposing at least one of the flanges 80 through one of the features 68*b*, the panel aperture 76 can substantially align with another feature 68 (e.g., the first aperture 68*a* on the opposite side of the electrical aperture 68). A fastener (e.g., a screw, a nail, a bolt, etc.) can be disposed through the panel aperture 76 and the feature 68*a* to couple together the panel 66 and the housing 12. As a result, in some embodiments, after coupling the panel 66 to the housing 12, the electrical connections 20 can be coupled to, extend through, and/or be supported by the clamp aperture 74 and the first body 70. For example, in some embodiments, the electrical connections 20 can electrically couple an electrical network of the structure into which the system 10 is installed to at least a portion of the electricity-requiring components of the system 10 (e.g., the ventilating assembly 14, the illumination device 18, etc.).

Figure 12B:
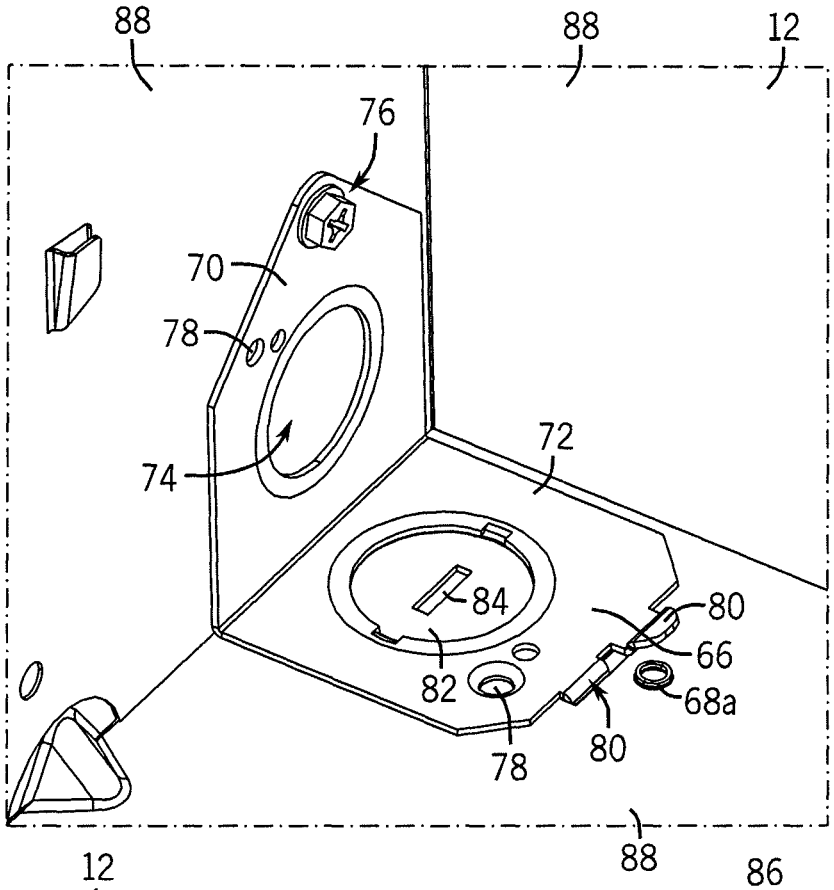
FIG. 12B is a perspective view of a panel coupled to a housing according to one embodiment of the invention.

Additionally, in some embodiments, the panel 66 can be coupled to the housing 12 in at least two different orientations. As previously mentioned, in some embodiments, the housing 12 can comprise both first apertures 68*a* and second apertures 68*b* adjacent to substantially opposite regions of the electrical aperture 64. As a result, in some embodiments, the panel 66 can be coupled to the housing 12 in at least two different orientations because the flanges 80 and the panel aperture 74 can align with the apertures 68*a*, 68*b* on either side of the electrical aperture 64. For example, as shown in FIG. 12A, in some embodiments, the first body 70 of the panel 66 can be oriented substantially parallel to a horizontal axis 75 of the housing 12, and as a result, the clamp aperture 74 can be disposed through a top portion of the housing 12 and the second body 72 can be oriented substantially perpendicular to the horizontal axis 75 of the housing 12. In other embodiments, as shown in FIG. 12B, the first body 70 of the panel 66 can be oriented substantially perpendicular to the horizontal axis 75 of the housing 12, and as a result, the clamp aperture 74 can be disposed through a sidewall portion of the housing 12 and the second body 72 can be oriented substantially parallel to the horizontal axis 75 of the housing 12. As a result of these multiple orientations, in some embodiments, the panel 66 can be coupled to the housing 12 in different manners to suit user needs. For example, if the electrical connections 20 are positioned in the building structure that restrict the location of the clamp aperture 74 to a given location (e.g., along the sidewall or the top portion of the housing 12), the panel 66 can be coupled to the housing 12 to suit these requirements. Furthermore, in some embodiments, the user/installer can also remove the knock-out region 82 to create two clamp apertures 74 for use with multiple electrical connections 20 or to introduce another clamp aperture 74 after coupling the panel 66 to the housing 12.

In some embodiments, the panel 66 can be coupled to the housing 12 in multiple configurations to enable installation of the system 10 in different situations. In some embodiments, the panel 66 can be configured and arranged to be coupled to an inner surface 88 of the housing 12. For example, as shown in FIGS. 12A and 12B, in some embodiments, during installation, the panel 66 can be disposed immediately adjacent to the inner surface 88 and coupled to the housing 12 using at least one of the flanges 80 and the panel aperture 76, as previously mentioned (e.g., the fastener can be driven from an interior of the housing 12 toward an exterior of the housing 12). Moreover, in some embodiments, the panel 66 can be disposed in at least two different orientations, as previously mentioned (e.g., the first body 70 can be either parallel or perpendicular to the horizontal axis 75 of the housing 12).

Figure 12C:
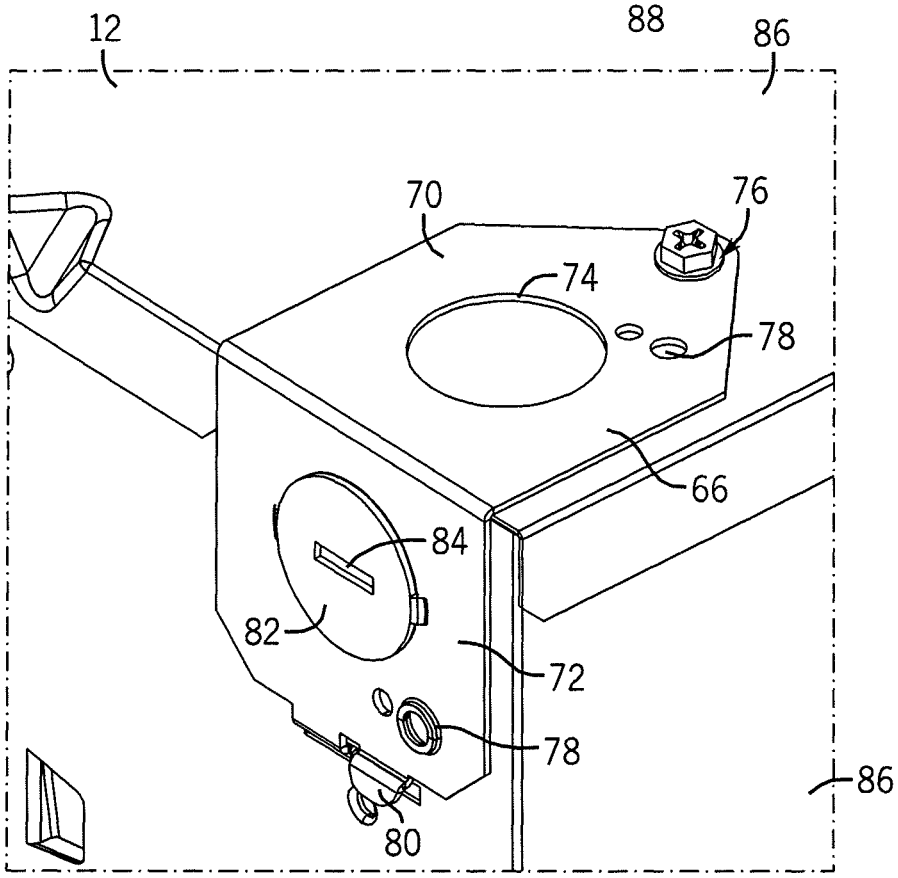
FIG. 12C is a perspective view of a panel coupled to a housing according to one embodiment of the invention.
Figure 12D:
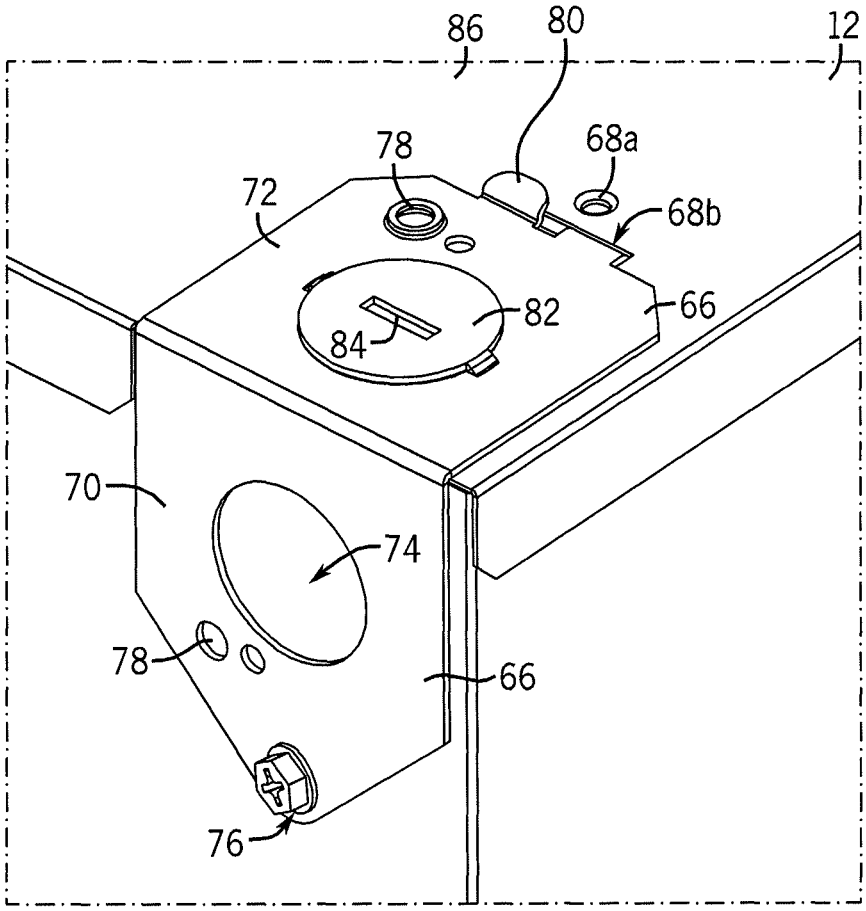
FIG. 12D a perspective view of a panel coupled to a housing according to one embodiment of the invention.

Additionally, as shown in FIGS. 12C and 12D, in some embodiments, the panel 66 can be coupled to an outer surface 86 of the housing 12. For example, as shown in FIGS. 12C and 12D, in some embodiments, during installation, the panel 66 can be disposed immediately adjacent to the outer surface 86 of the housing 12 and coupled using at least one of the flanges 80 and the panel aperture 76, as previously mentioned (e.g., the fastener can be driven from the exterior of the housing 12 toward the interior of the housing 12). Moreover, in some embodiments, the panel 66 can be disposed in at least two different orientations, as previously mentioned (e.g., the first body 70 can be either parallel or perpendicular to the horizontal axis 75 of the housing 12).

In some embodiments, the system 10 can be installed in multiple building structure configurations because of the panel 66 and the housing 12 being configured and arranged to enable multiple configurations and orientations of the panel 66 coupled to the housing 12. For example, as previously mentioned with respect to the mounting apparatus 24, in some embodiments, the system 10 can be installed in a structure that is not yet complete (e.g., portions of the structure, such as walls, dry wall, ceilings, etc. are not yet installed). As a result, the installer can have relatively easy access to multiple portions of the system 10 before, during, and/or after installation, such as the outer surface 86 of the housing 12. Accordingly, in some embodiments, the panel 66 can be coupled to the outer surface 86 of the housing 12 if that is a desirable configuration for the user/installer. For example, in some embodiments, it can be easier for the installer/user to couple the panel 66 to the outer surface 86, if that option is available. Moreover, in some embodiments, the panel 66 can be coupled to the housing 12 in an orientation so that the clamp aperture 74 can be disposed in a location that enables installation of the electrical connections 20. For example, in some embodiments, the electrical connections 20 can extend from a portion of the structure that requires the clamp aperture 74 to be parallel or perpendicular to the horizontal axis 75 of the housing 12, and, accordingly, the panel 66 can be coupled to the housing 12 to provide the clamp aperture 74 in the needed orientation.

Additionally, in some embodiments, the panel 66 can be coupled to the housing 12 after the mounting apparatus 24 has been coupled to the building structure. As previously mentioned, in some embodiments, the system 10 can be installed within a building structure that is already substantially complete (e.g., a retrofit installation). Moreover, in some embodiments, the panel 66 can be coupled to the inner surface 88 of the housing 12 before or after coupling the mounting apparatus 24 and the housing 12 to the building structure. In some embodiments, after coupling the housing 12 to the building structure, the panel 66 can be coupled to the inner surface 88 of the housing 12 to enable installation of the electrical connections 20. For example, in some embodiments, it can be difficult to couple the panel 66 to the outer surface 86 after coupling the housing 12 to the building structure (e.g., it can be difficult to access the electrical aperture 64 from an exterior direction). As a result, in some embodiments, the user/installer can couple the panel 66 to the inner surface 88 in a manner similar to some previously mentioned embodiments. Moreover, in some embodiments, the panel 66 can be coupled to the housing 12 in an orientation so that the clamp aperture 74 can be disposed in a location that enables installation of the electrical connections 20. For example, in some embodiments, the electrical connections 20 can extend from a portion of the structure that requires the clamp aperture 74 to be parallel or perpendicular to the horizontal axis 75 of the housing 12, and, accordingly, the panel 66 can be coupled to the housing 12 to provide the clamp aperture 74 in the needed orientation.

Accordingly, in some embodiments, the panel 66 can enable installation in building structures comprising multiple configurations. For example, when the installer can access the exterior portions of the housing 12, the panel 66 can be coupled to the outer surface 86 of the housing 12, with the clamp aperture 74 capable of being in at least two different positions. Moreover, in some embodiments, the panel 66 can be coupled to the inner surface 88 of the housing 12, with the clamp aperture 74 capable of being in at least two different positions, when the installer can more easily access the interior portions of the housing 12. Furthermore, in some embodiments, the panel 66 can be coupled to the inner surface 88 or the outer surface 86 regardless of installer access to exterior and/or interior portions of the housing 12. For example, the installer can couple the panel 66 to the outer surface 86 in a retrofit installation or the installer can couple the panel 66 to the inner surface 88 in a non-retrofit installation (e.g., the type of installation does not limit the portion of the housing 12 to which the panel 66 can be coupled).

Figure 13:
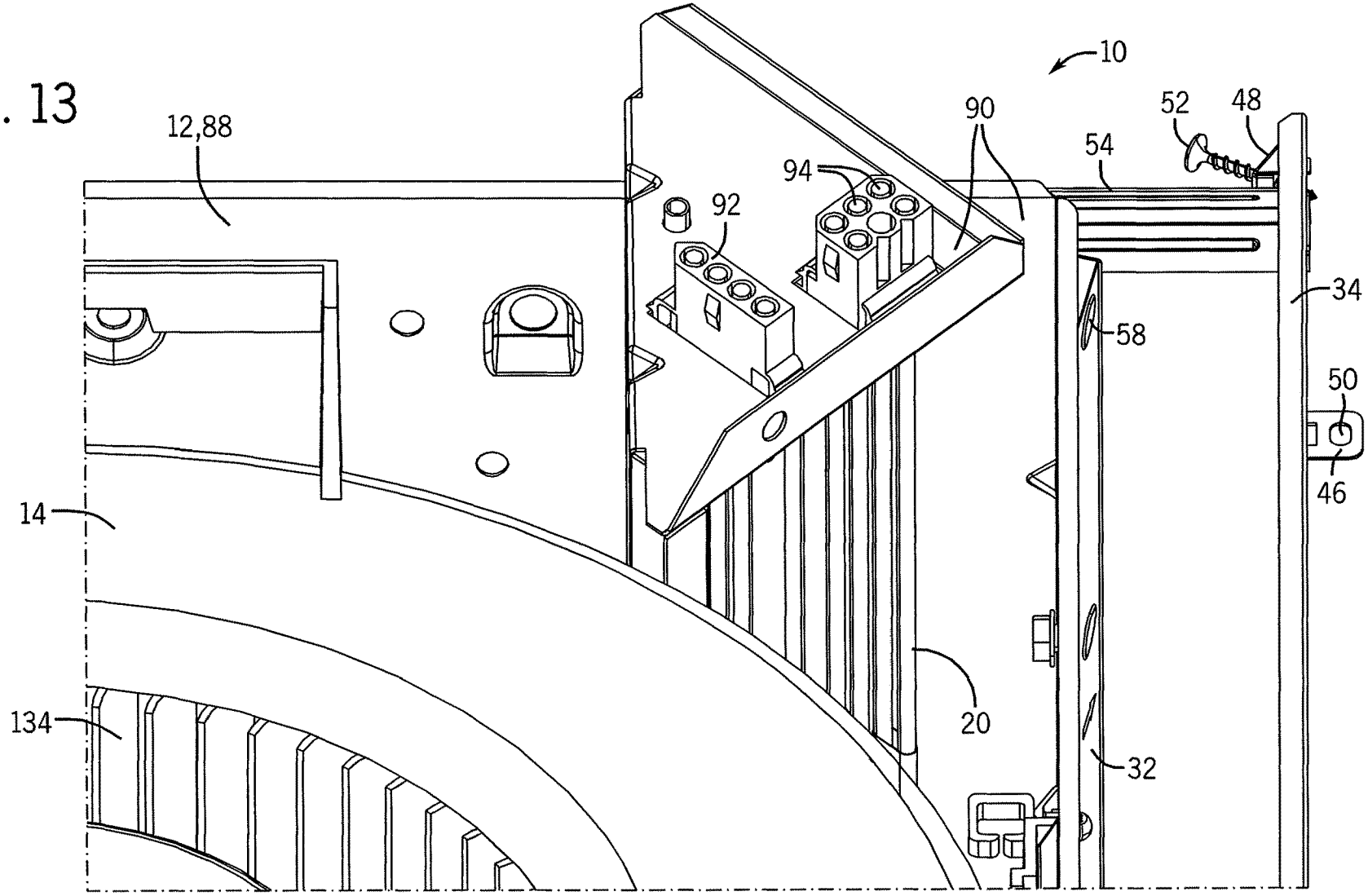
FIG. 13 is a perspective view of an electrical compartment and ventilating assembly according to one embodiment of the invention.

In some embodiments, the system 10 can comprise an electrical connections compartment 90. In some embodiments, as shown in FIGS. 6 and 13, the electrical connections compartment 90 can comprise at least a portion of the electrical connections 20 that enter the housing via the clamp aperture 74 of the panel 66. In some embodiments, the compartment 90 can be coupled to the inner surface 88 of the housing 12 so that the compartment 90 is positioned substantially adjacent to the panel 66. In some embodiments, the electrical connections compartment 90 can be configured and arranged to receive the electrical connections 20 and support at least one electrical receptacle 92. In some embodiments, the compartment 90 can comprise two electrical receptacles 92. In some embodiments, the receptacles 92 can be coupled to the compartment 90. For example, as shown in FIG. 13, the electrical connections 20 can extend through the clamp aperture 74 and enter the electrical connections compartment 90. The electrical connections 20 can extend through at least a portion of the compartment 90 and engage the receptacles 92 coupled to the compartment 90. As a result, in some embodiments, the receptacles 92 can comprise an outlet for connecting other elements of the system 10 to provide electricity. In some embodiments, the receptacles 92 can be configured and arranged to provide electricity to at least the ventilating assembly 14 and/or the illumination device 18. For example, as shown in FIG. 13, the receptacles 92 can comprise multiple recesses 94 that can receive portions of wiring that can electrically couple to at least some of the electricity-requiring elements of the system 10. In some embodiments, the electrical connection compartment 90 substantially encloses the electrical connections 20 to prevent inadvertent contact with other elements of the system 10.

Figure 14:
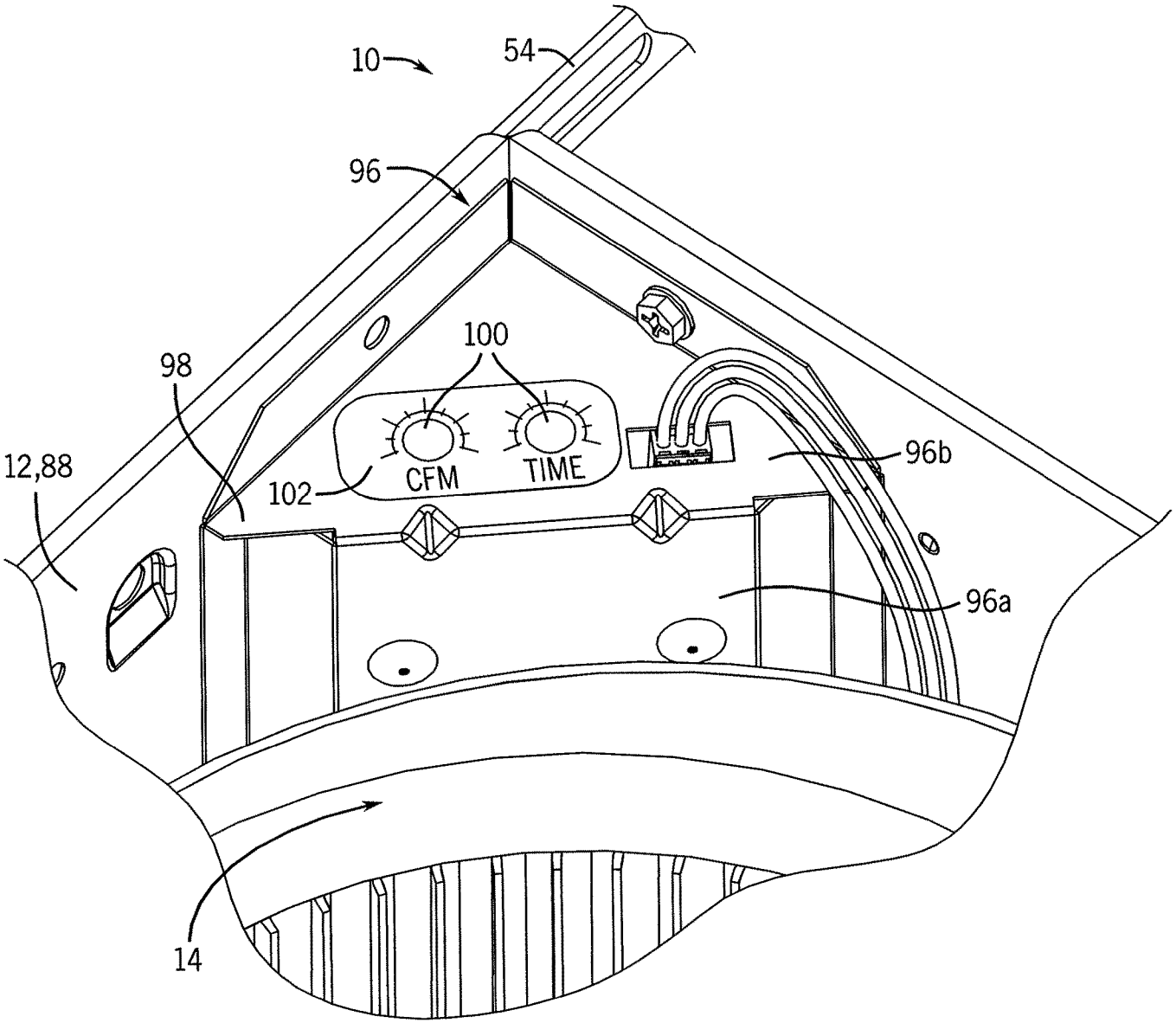
FIG. 14 is a perspective view of a motor control compartment and ventilating assembly according to one embodiment of the invention.

In some embodiments, the system 10 can comprise a motor control compartment 96, as shown in FIG. 14. In some embodiments, the motor control compartment 96 can comprise a body **96*a* and a cover 96*b*. In some embodiments, the body 96*a* can be disposed in a corner of the housing 12. By way of example only, in some embodiments, the body 96*a* can be coupled to the inner surface 88 in a corner of the housing 12 that is substantially diagonally opposing the electrical connections compartment 90. In some embodiments, a motor control apparatus (not shown) can be disposed within the motor control compartment 96. As described in further detail below, the motor control apparatus can control different operational parameters of the motor 28 and the ventilating assembly 14. In some embodiments, the cover 96*b* can be coupled to the inner surface 88 so that the cover 96*b* substantially encloses the body 96*a*** and the motor control apparatus.

Moreover, in some embodiments, the cover **96*b* can comprise several elements. In some embodiments, the cover 96*b* can comprise at least one cover flange 98 at a lateral edge of the cover 96*b*. For example, in some embodiments, the cover flange 98 can be used by a user/installer for installation or removal of the cover 96*b* (e.g., to access the motor control apparatus). In some embodiments, the cover 96*b* can comprise at least one control aperture 100. For example, as shown in FIG. 14, the cover 96*b* can comprise two control apertures 100 through which the user/installer can access the motor control apparatus without having to remove the cover 96*b*. Furthermore, in some embodiments, the cover 96*b* can comprise a label 102 corresponding to operational parameters of the motor 28. As a result, the user/installer can access the motor control apparatus via the apertures 100 and adjust the operational parameters of the motor 28 to correspond with the markings on the label 102. Additionally, in some embodiments, the motor control compartment 96 can be electrically connected to at least one of the receptacles 92 of the electrical connections compartment 90**.

In some embodiments, the system 10 can comprise a duct connector assembly 104. In some embodiments, the duct connection assembly 104 can be coupled to the housing substantially adjacent to the ventilation outlet 22 and in fluid communication with the ventilating assembly 14, as shown in FIG. 6. In some embodiments, the duct connector assembly 104 can be configured and arranged to fluidly connect the system 10 with the environment surrounding the system 10. In some embodiments, the duct connector assembly 104 can be coupled to a ventilating network of the building. For example, in some embodiments, the duct connector assembly 104 can be coupled to ductwork of the building. As a result, at least a portion of any fluid (e.g., air) moving through the system 10 can exit the system 10 via the outlet 22 and the duct connector assembly 104 and flow through the ductwork to exit the building.

Figure 15:
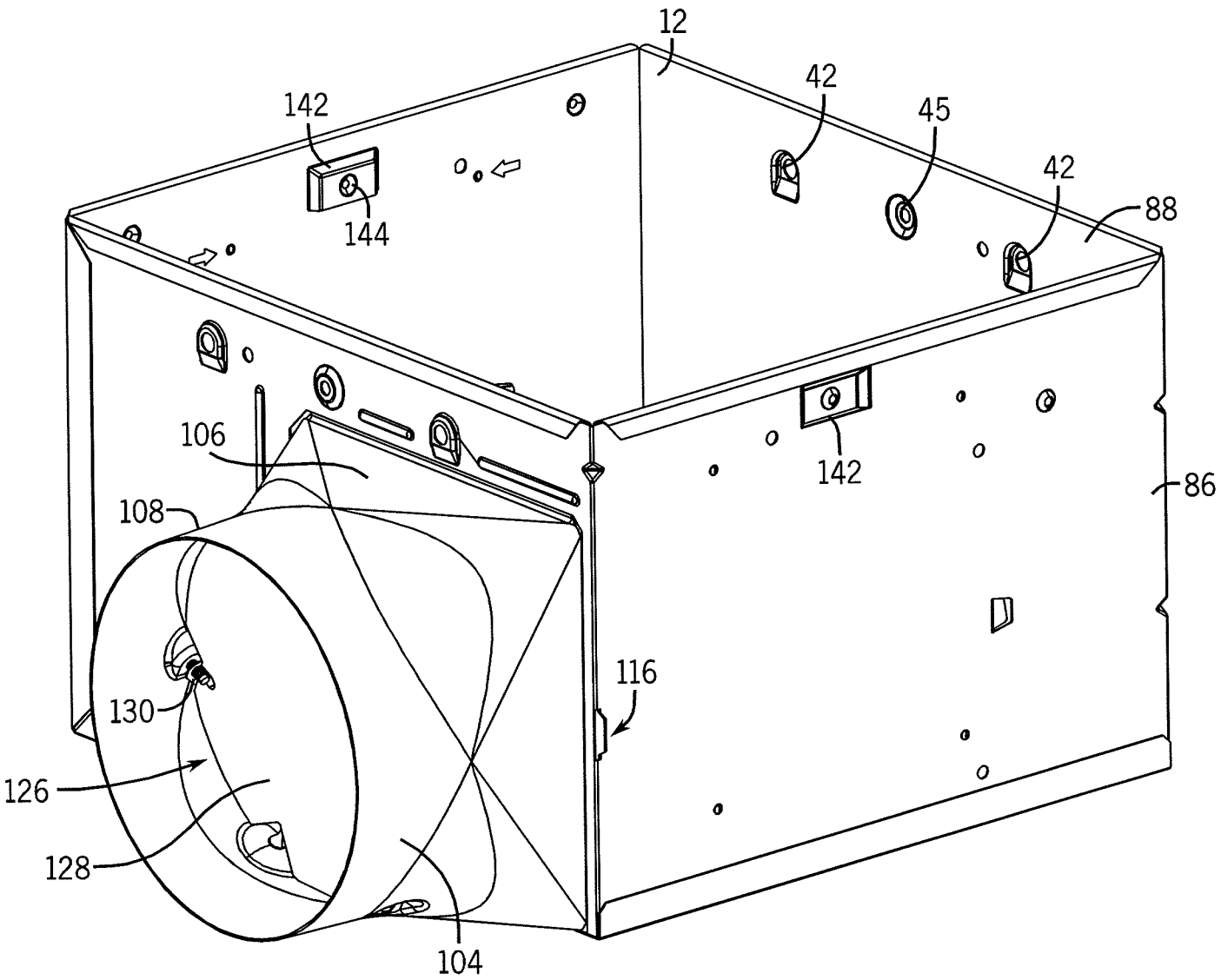
FIG. 15 is a perspective view of a duct connector assembly and a ventilating assembly according to one embodiment of the invention.

In some embodiments, the duct connector assembly 104 can comprise multiple regions. In some embodiments, the duct connector assembly 104 can comprise a base region 106 and a connection region 108, as shown in FIG. 15. In some embodiments, the base region 106 and the connection region 108 can comprise different configurations. For example, as shown in FIG. 15, in some embodiments, the base region 106 can comprise a substantially square configuration and the connection region 108 can comprise a substantially annular configuration. In other embodiments, the base region 106 and/or the connection region 108 can comprise other configurations (e.g., rectangular, elliptical, regular or irregular polygonal, etc.).

In some embodiments, the shape of the regions 106, 108 can be at least partially correlated to the elements to which the regions 106, 108 can be coupled. By way of example only, in some embodiments, the ventilation outlet 22 can comprise a substantially square configuration and the base region 106 can substantially correspond to that configuration. Moreover, in some embodiments, the ductwork can comprise a substantially annular configuration and the connection region 108 can substantially correspond to that configuration. In other embodiments, the regions' 106, 108 configurations need not necessarily correspond to the shape of the outlet 22 and the ductwork (e.g., the shapes of the regions 106, 108 are not limited by the shapes of the elements to which they can be coupled).

Figure 16:
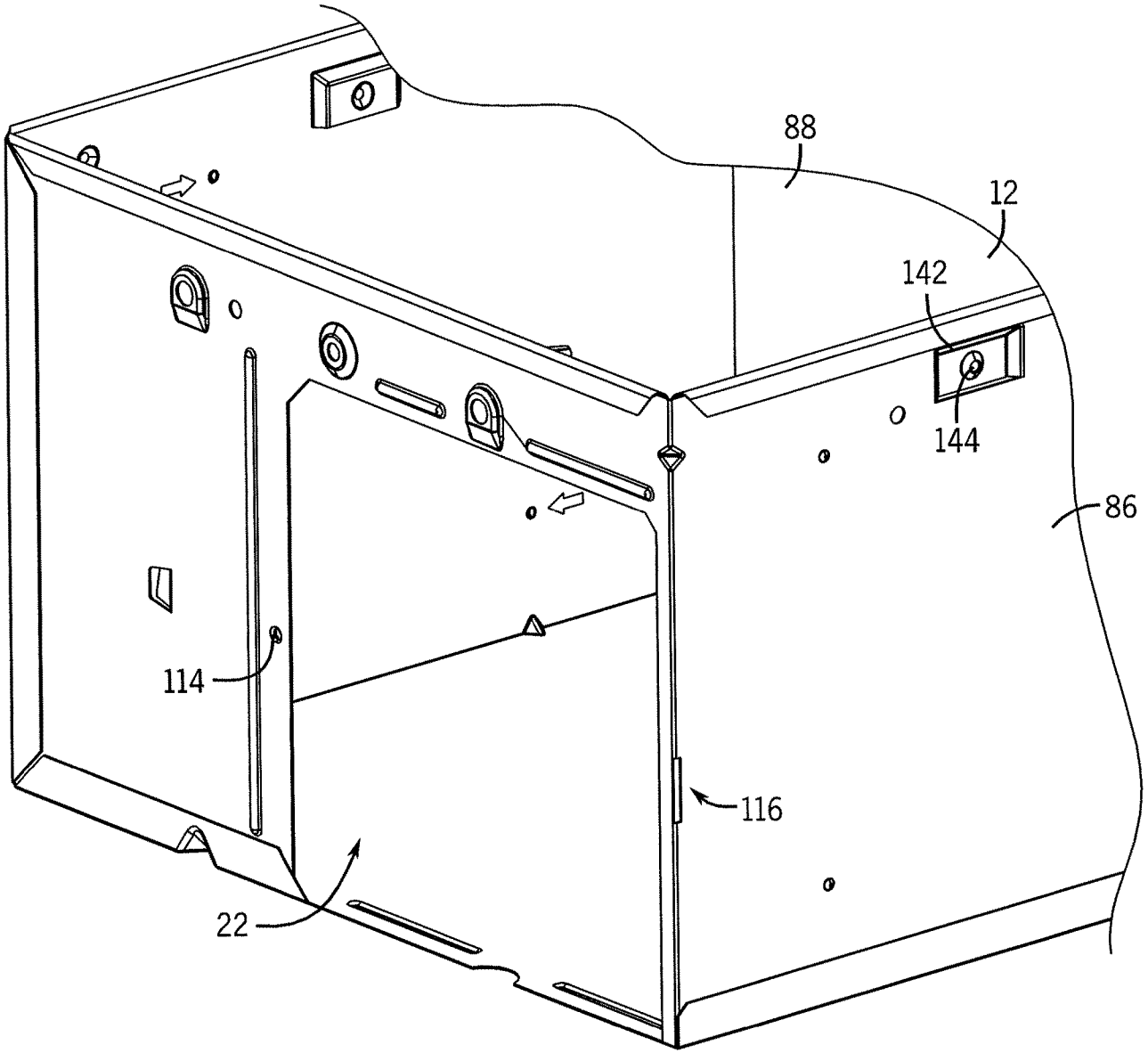
FIG. 16 is an expanded perspective view of a portion of a housing according to one embodiment of the invention.
Figure 17A:
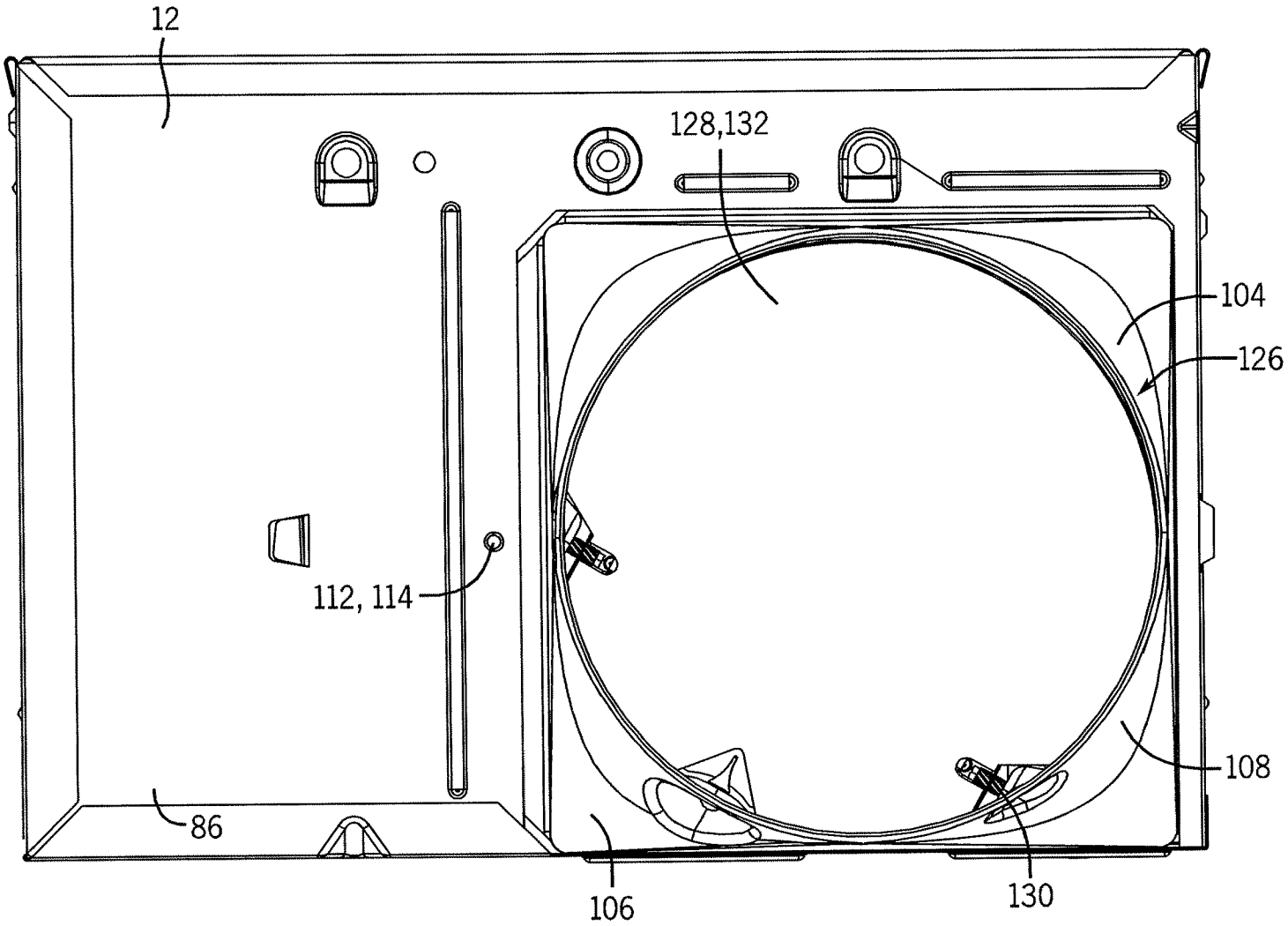
FIGS. 17A and 17B are perspective views of a duct connector assembly coupled to a portion of a housing according to some embodiments of the invention.
Figure 17B:
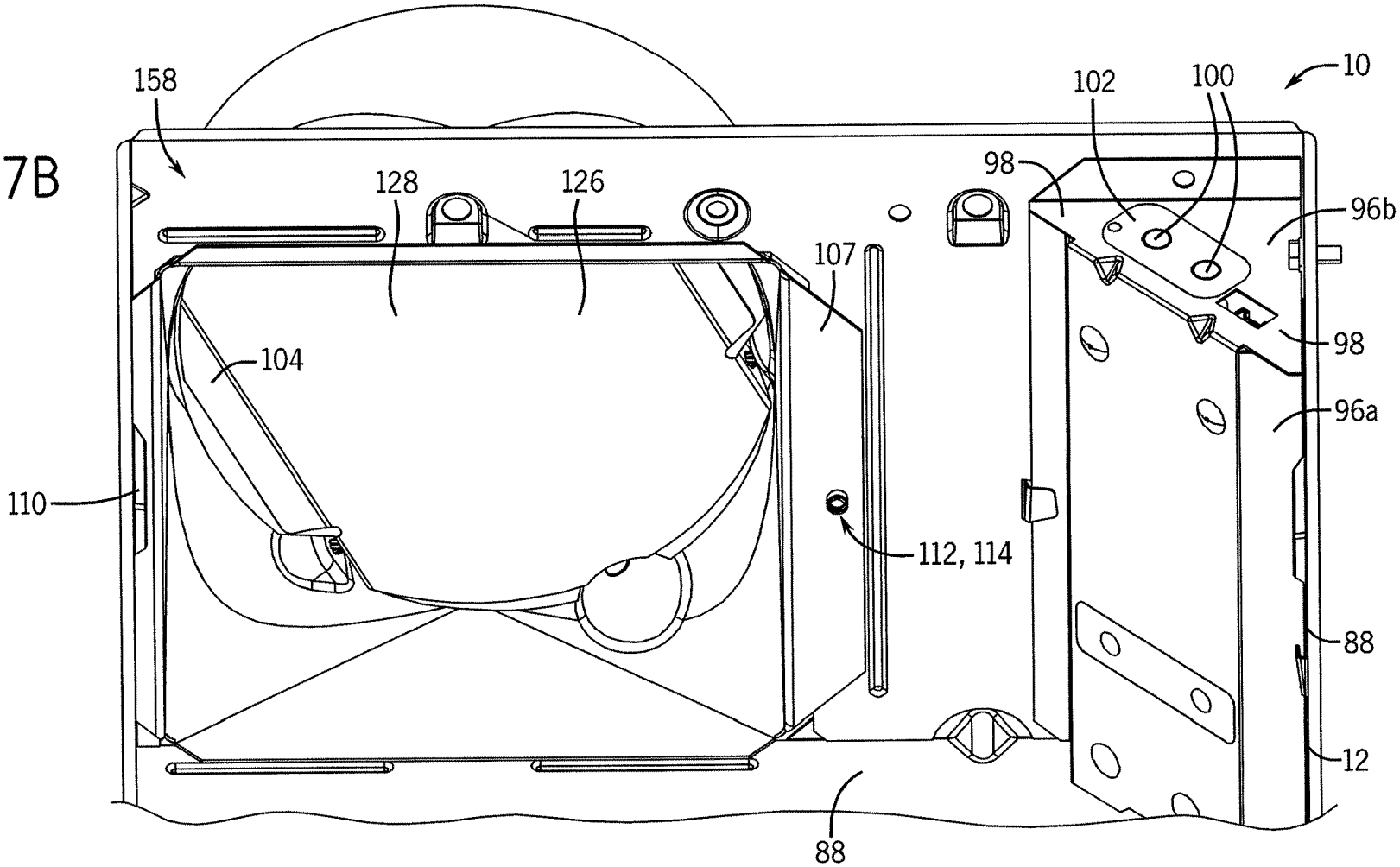

In some embodiments, the base region 106 can comprise elements to aid in coupling the duct connector assembly 104 to the housing 12. In some embodiments, the base region 106 can comprise a coupling flange 107 and a positioning tab 110, as shown in FIG. 17B. For example, in some embodiments, the base region 106 can comprise the square-shaped configuration and the coupling flange 107 can laterally extend from a first side of the base region 106 and the positioning tab 110 can laterally extend from another side of the base region 106 substantially opposite the first side of the base region 106. Moreover, in some embodiments, the coupling flange 107 can comprise an aperture 112. For example, the aperture 112 can be disposed through a portion of the flange 107 and can be configured to receive a fastener (e.g., a screw, a nail, etc.) to couple the base region 106 to the housing 12. Moreover, in some embodiments, the housing 12 can comprise an outlet aperture 114 disposed through a portion of the housing 12 substantially adjacent to the ventilation outlet 22. In some embodiments, the housing 12 can also comprise an outlet recess 116 positioned on the housing 12 so that the recess 116 is on a substantially opposite side of the outlet 22 relative to the aperture 114, as shown in FIG. 16.

In some embodiments, the duct connector assembly 104 can be coupled to the housing 12. In some embodiments, the base region 106 can be at least partially aligned and brought into position by disposing the positioning tab 110 at least partially within the outlet recess 116. In some embodiments, after disposing the tab 110 within the recess 116, the flange aperture 112 can substantially align with the outlet aperture 114. As a result, in some embodiments, a fastener can be disposed through the apertures 112, 114 to couple the base region 106 to the housing 12.

In some embodiments, the duct connector assembly 104 can be coupled to the housing 12 in multiple configurations. In some embodiments, the duct connector assembly 104 can be coupled to the housing 12 so that the coupling flange 107 is disposed immediately adjacent to one of the outer surface 86 or the inner surface 88. Similar to the mounting apparatus 24 and the panel 66, in some embodiments, the duct connector assembly 104 can be coupled to the housing 12 in different manners to accommodate installation in building structures comprising different stages of completion. For example, as previously mentioned with respect to the mounting apparatus 24, in some embodiments, the system 10 can be installed in a structure that is not yet complete (e.g., portions of the structure, such as walls, dry wall, ceilings, etc. are not yet installed). As a result, the installer can have relatively easy access to multiple portions of the system 10 before, during, and/or after installation, such as the outer surface 86 of the housing 12. Accordingly, in some embodiments, the duct connector assembly 104 can be coupled to the outer surface 86 of the housing 12 if that is a desirable configuration for the user/installer. For example, in some embodiments, from the exterior of the housing 12, the positioning tab 110 can be disposed through the outlet recess 116 to substantially position the base region 106. Moreover, in some embodiments, the coupling flange 107 can be disposed substantially immediately adjacent to the outer surface 86 and a fastener can be driven through the flange aperture 112 and the outlet aperture 114 from the exterior toward the interior of the housing 12, as shown in FIG. 18.

Additionally, in some embodiments, the duct connector assembly 104 can be coupled to the housing 12 after the mounting apparatus 24 has been coupled to the building structure. As previously mentioned, in some embodiments, the system 10 can be installed within a building structure that is already substantially complete (i.e., a retrofit installation). Moreover, in some embodiments, the duct connector assembly 104 can be coupled to the inner surface 88 of the housing 12 before or after coupling the mounting apparatus 24 and the housing 12 to the building structure and coupling the connection region 108 to the ductwork. In some embodiments, after coupling the housing 12 to the building structure, the duct connector assembly 104 can be coupled to the inner surface 88 of the housing 12 to enable coupling of the connection region 108 to the ductwork.

For example, in some embodiments, it can be difficult to couple the duct connector assembly 104 to the outer surface 86 after coupling the housing 12 to the building structure (e.g., it can be difficult to access the connection region 108 from an exterior direction). Moreover, in some embodiments, in a retrofit installation, coupling together the duct connector assembly 104 and the ductwork can be difficult because of limited access to the exterior of the housing 12. As a result, in some embodiments, the user/installer can couple the duct connector assembly 104 to the ductwork and then couple the base region 106 to the inner surface 88 by disposing the positioning tab 110 at least partially within the outlet recess 116 and disposing the coupling flange 107 substantially immediately adjacent to the inner surface 88 so that the fastener can be driven through the flange aperture 112 and the outlet aperture 114 from the interior toward the exterior of the housing 12, as shown in FIG. 17B.

Figure 18:
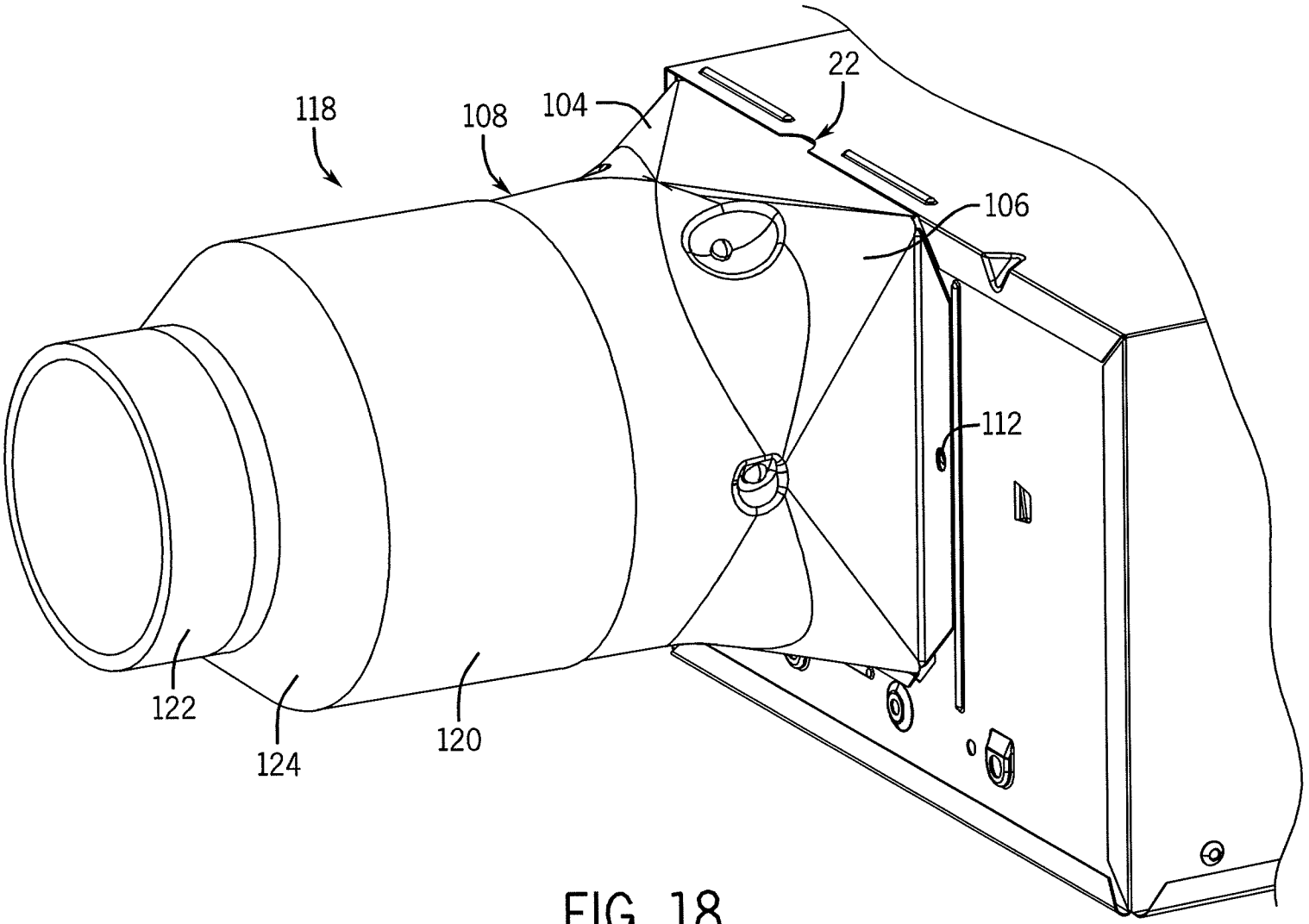
FIG. 18 is a perspective view of a duct connector assembly and a duct adapter according to one embodiment of the invention.

In some embodiments, the duct connector assembly 104 can comprise a duct adapter 118, as shown in FIG. 18. In some embodiments, the duct adapter 118 can be reversibly or irreversibly coupled to the connection region 108. In some embodiments, the duct adapter 118 can be configured and arranged to enable coupling variably-sized ductwork to the connection region 108. For example, in some embodiments, the connection region 108 can comprise a circumference greater than a circumference of the ductwork, which can complicate fluidly coupling the duct connector assembly 104 to the ductwork.

In some embodiments, the duct adaptor 118 can comprise a first region 120, a second region 122, and a third region 124, as shown in FIG. 18. In some embodiments, the first region 120 can be configured and arranged to receive the connection region 108 to couple the duct adapter 118 to the duct connector assembly 104. For example, in some embodiments, the first region 120 can comprise a diameter substantially similar to the diameter of the connection region 108. As a result, in some embodiments, the connection region 108 and the first region 120 can be coupled together (e.g., via conventional fasteners, adhesives, an interference fit, etc.). In some embodiments, the second region 122 can comprise a diameter less than that of the first region 120. By way of example only, in some embodiments, the first region 120 can comprise a diameter of approximately six inches and the second region 122 can comprise a diameter of approximately four inches, although, in other embodiments, the regions 120, 122 can comprise other diameters. Moreover, in some embodiments, the third region 124 can be disposed between the first and the second regions 120, 122. For example, as shown in FIG. 18, in some embodiments, the third region 124 can comprise a transition region where the diameter of the duct adaptor 118 can be variable. As shown in FIG. 18, in some embodiments, the diameter of the third region 124 can lessen closer to the second region 122. As a result, the duct adaptor 118 can enable coupling the duct connector assembly 104 to ductwork of multiple sizes.

Figure 19:
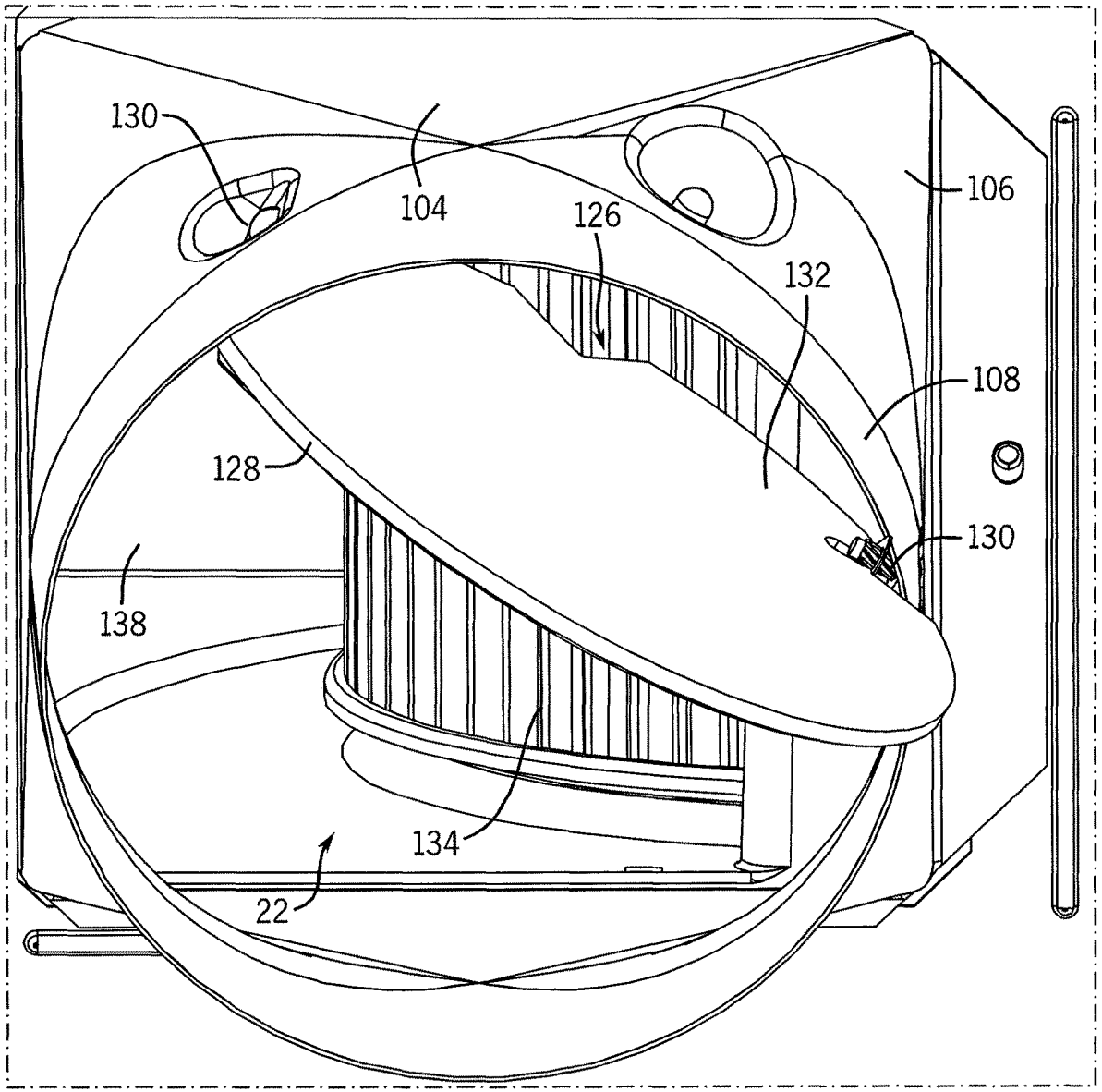
FIG. 19 is a front view of a duct connector assembly according to one embodiment of the invention.

In some embodiments, the duct connector assembly 104 can comprise a damper assembly 126, as shown in FIG. 19. In some embodiments, the damper assembly 126 can be movably coupled to the duct connector assembly 104. In some embodiments, the damper assembly 126 can comprise a flap 128 movably coupled to the duct connector assembly 104. By way of example only, in some embodiments, the flap 128 can be coupled to mounts 130 disposed through portions of the duct connector assembly 104 and the mounts 130 can be configured and arranged so that the flap 128 can rotate about an axis of the mounts 130. In some embodiments, the flap 128 can comprise different materials, such as, but not limited to a metal, such as sheet metal, a polymer, or other materials. Furthermore, in some embodiments, the mounts 130 can comprise resilient bushings that can at least partially enhance operation of the flap 128. For example, the resilient bushings can at least partially reduce some or all of the audible output (e.g., operational noise) of the flap 128 during operations of the system 10.

Further, in some embodiments, the flap 128 can be coupled to the duct connector assembly 104 so that the flap 128 can substantially seal the system 10 from the ductwork. For example, in some embodiments, when the ventilating system 14 is substantially inactive (e.g., little to no air is flowing through the system 10), the flap 128 can be positioned to substantially seal the duct connector assembly 104 (e.g., the flap 128 can be in a substantially vertical position). In some embodiments, after activation of the ventilating system 14, a fluid, such as air, can flow through the system 10 and exit the housing 12 via the duct connector assembly 104. As a result, the air exiting the system 10 can provide enough force for the flap 128 to move from the substantially sealed positioned (e.g., the substantially vertical position) to an angled position to enable air to flow from the system 10. Moreover, in some embodiments, the flap 128 can comprise a material, a shape, a position, and a mass great enough so that after air flow ceases, the flap 128 can substantially automatically return to the substantially sealed position to once again seal the system 10 from the ductwork. Additionally, in some embodiments, the flap 128 can comprise a sealing panel 132 configured and arranged to further seal the duct connector assembly 104. For example, in some embodiments, the sealing panel 132 can be coupled to a face of the flap 128 to enhance sealing of the system 10. In some embodiments, the sealing panel 132 can comprise a foam-like material or other material that is capable of flexibly engaging the flap 128 and the duct connector assembly 104.

Figure 20:
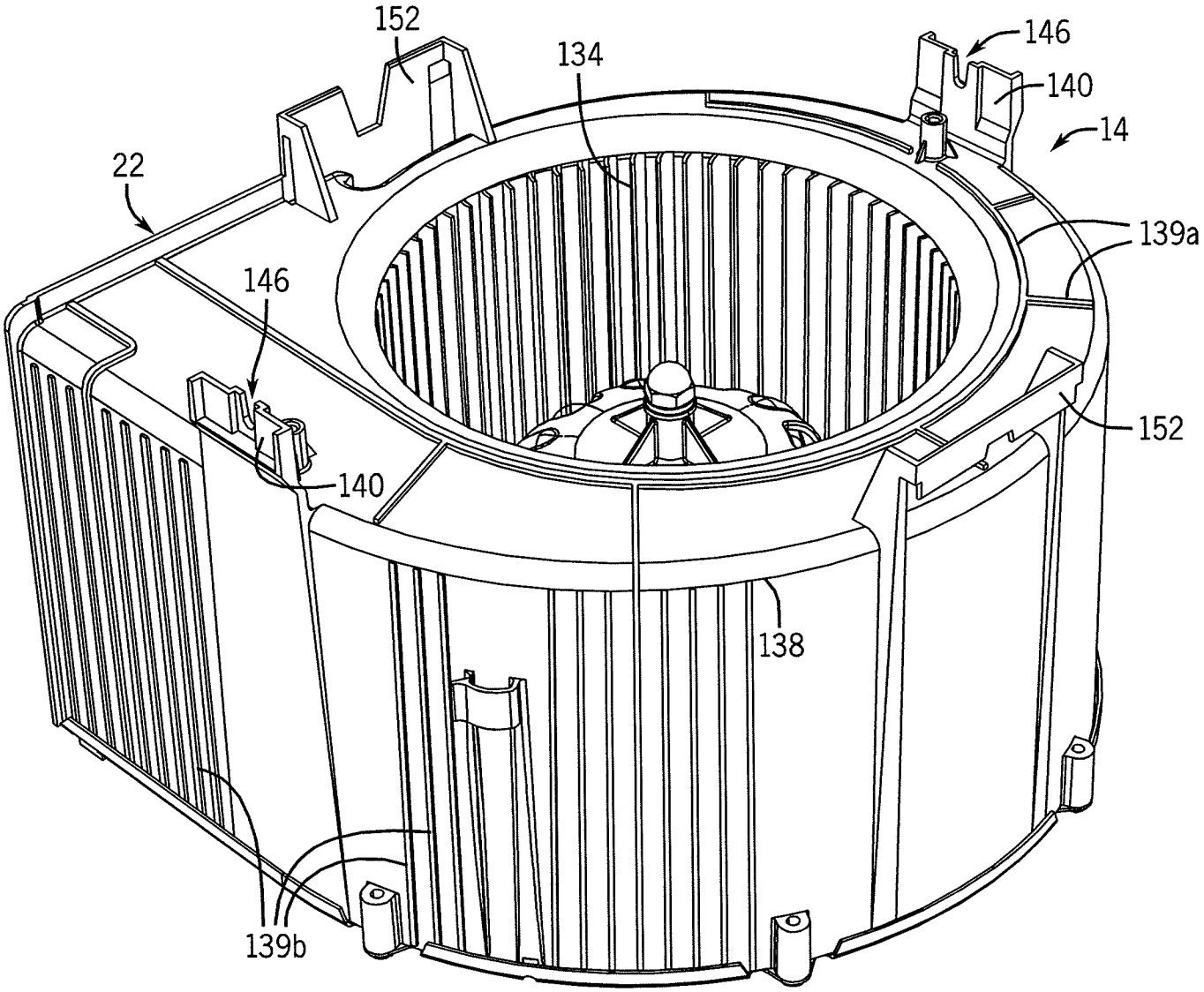
FIG. 20 is a perspective view of a ventilating assembly according to one embodiment of the invention.

Referring to FIG. 20, in some embodiments of the invention, the ventilating assembly 14 can be coupled to the housing 12 and can include a centrifugal fan or fan apparatus 134 operatively coupled to the motor 28. In some embodiments, any other type of fan other than a centrifugal fan 134 can be employed, including propeller-type fans.

Figure 21:
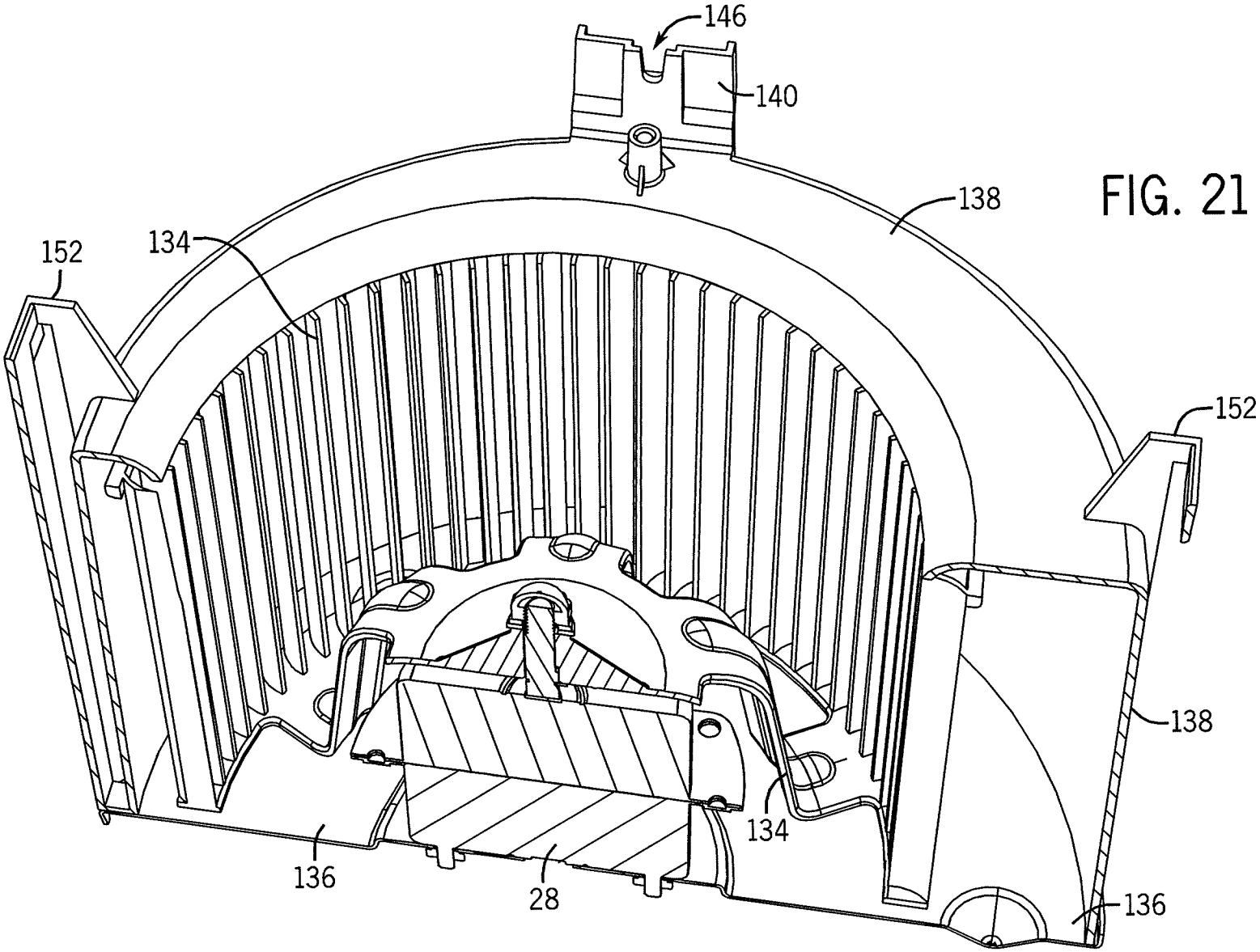
FIG. 21 is a cross-sectional view of the ventilating assembly of FIG. 20.

In some embodiments, the ventilating assembly 14 can comprise a support plate 136 coupled to a substantially arcuate, upstanding wall 138. Moreover, in some embodiments, the motor 28 can be coupled to and/or supported by the support plate 136, as shown in FIGS. 20 and 21. In some embodiments, the motor 28 can be operatively coupled to the fan 134 so that the fan 134 is disposed substantially adjacent to the wall 138 of the ventilating assembly 14. In some embodiments, the support plate 136 together with the upstanding wall 138, can define a scroll housing for generating airflow. In some embodiments, the fan 134 can be positioned relative to the upstanding wall 138 to form a scroll inlet to receive air from the surrounding environment, and a scroll outlet to discharge air out of the ventilating outlet 22.

Figure 28:
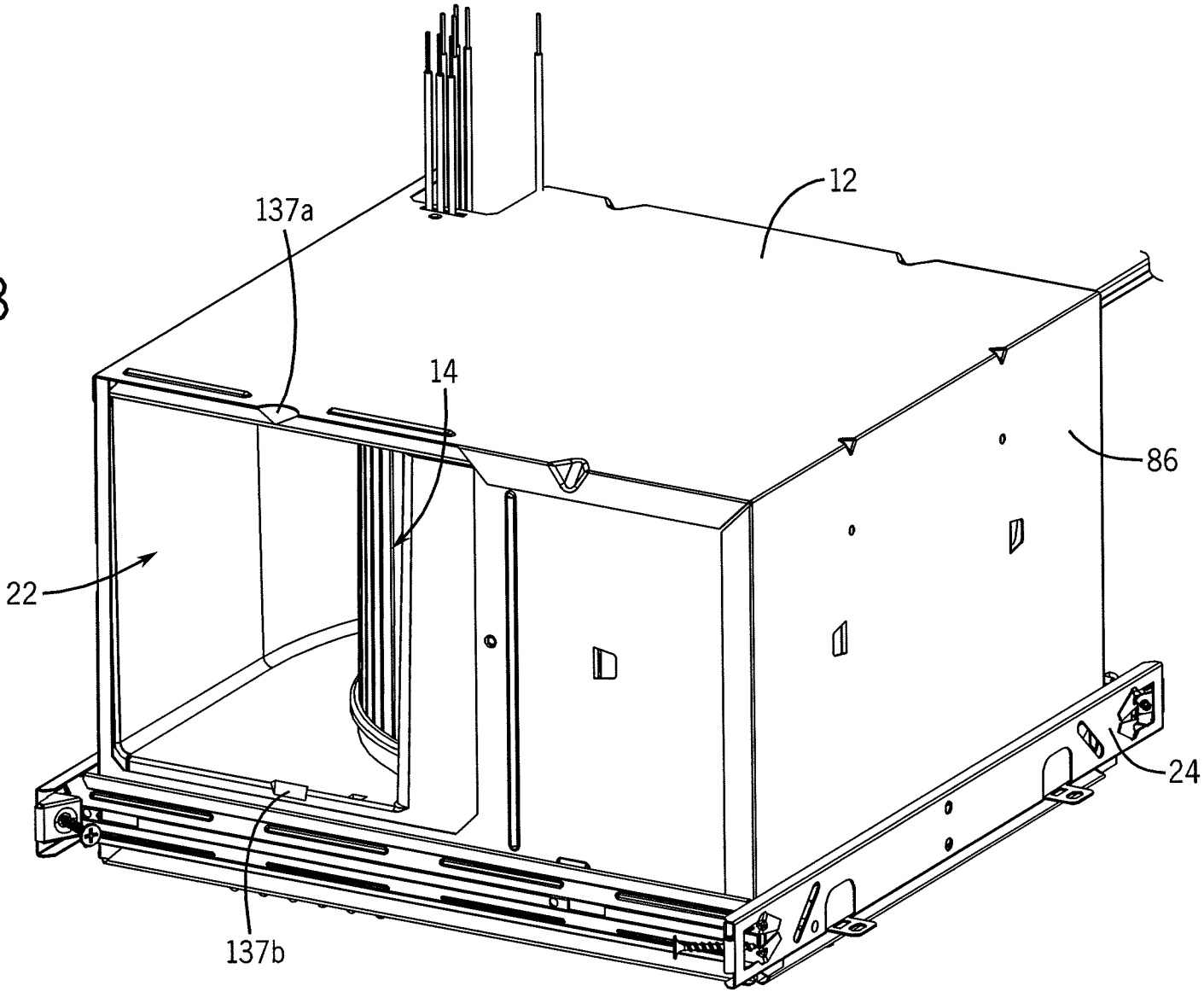
FIG. 28 is a perspective view of a housing including a ventilating assembly according to one embodiment of the invention.

In some embodiments, at least a portion of the elements of the ventilating assembly 14 can comprise features that can aid in positioning the assembly 14 and the mounting apparatus 24. Referring to FIG. 28, in some embodiments, the support plate 136 and/or the wall 138 can comprise positioning features 137. For example, in some embodiments, the support plate 136 can comprise a positioning feature 137*a* that can engage with at least a portion of the outer surface 86 substantially adjacent to the outlet 22, as shown in FIG. 28. Similarly, in some embodiments, the wall 138 can comprise a similar positioning feature 137*b* that can engage with at least a portion of the housing 12 (e.g., the outer surface 86). As a result, in some embodiments, the ease with which the housing 12 can be coupled to the mounting apparatus 24 can be at least partially enhanced.

In some embodiments, the ventilating assembly 14 can comprise a plurality of ribs 139. For example, as shown in FIG. 20, in some embodiments, at least a portion of the wall 138 can comprise substantially horizontal ribs 139*a* and/or substantially vertical ribs 139*b*. In some embodiments, the ribs 139*a*, 139*b* can at least partially provide structural support and improve operations of the ventilating assembly 14. For example, the ribs 139*a*, 139*b* can at least partially reinforce some horizontal and vertical surfaces, which, in some embodiments, can reduce or prevent vibration and noise during assembly 14 operation.

In some embodiments, the ventilating assembly 14 can comprise a substantially integral unit. For example, as shown in FIGS. 20 and 21, in some embodiments, the wall 138, the plate 136, the motor 28, and the fan 134 can be delivered to the user/installer as a substantially single unit (e.g., preassembled). As a result, in some embodiments, the ventilating assembly 14 can be readily installed and uninstalled from the system 10 without significant concern for assembling the individual elements of the ventilating assembly 14. In some embodiments, the wall 138, the support plate 136, and/or the fan 134 can comprise different materials. In some embodiments, at least a portion of these elements can comprise injection-molded polymers, sheet metal, or any other suitable material. For example, in some embodiments, the wall 138, the support plate 136, and/or the fan 134 can comprise a polymer so that production costs and the weights of these elements can be reduced relative to embodiments comprising other materials, such as sheet metal.

In some embodiments, the ventilating assembly 14 can be coupled to the housing 12. In some embodiments, as shown in FIG. 20, the ventilating assembly 14 can comprise at least one coupling tab 140 configured and arranged to at least partially provide for coupling the housing 12 and the ventilating assembly. In some embodiments, the ventilating assembly 14 can comprise two coupling tabs 140 extending from substantially opposite ends of the ventilating assembly 14, as shown in FIG. 20. In some embodiments, the coupling tabs 140 can be configured and arranged to substantially automatically couple together the ventilating assembly 14 and the housing 12. For example, in some embodiments, the coupling tabs 140 can comprise a snap-fit configuration. Further, in some embodiments, the housing 12 can comprise receiving members 142 extending inward from the inner surface 88. As a result, in some embodiments, the ventilating assembly 14 can be positioned within the housing 12 so that the coupling tabs 140 substantially align with and engage the receiving members 142. After engaging the receiving members 142, the coupling tabs 140 can substantially automatically snap into position and at least partially couple the ventilating assembly 14 to the housing 12.

Figure 22:
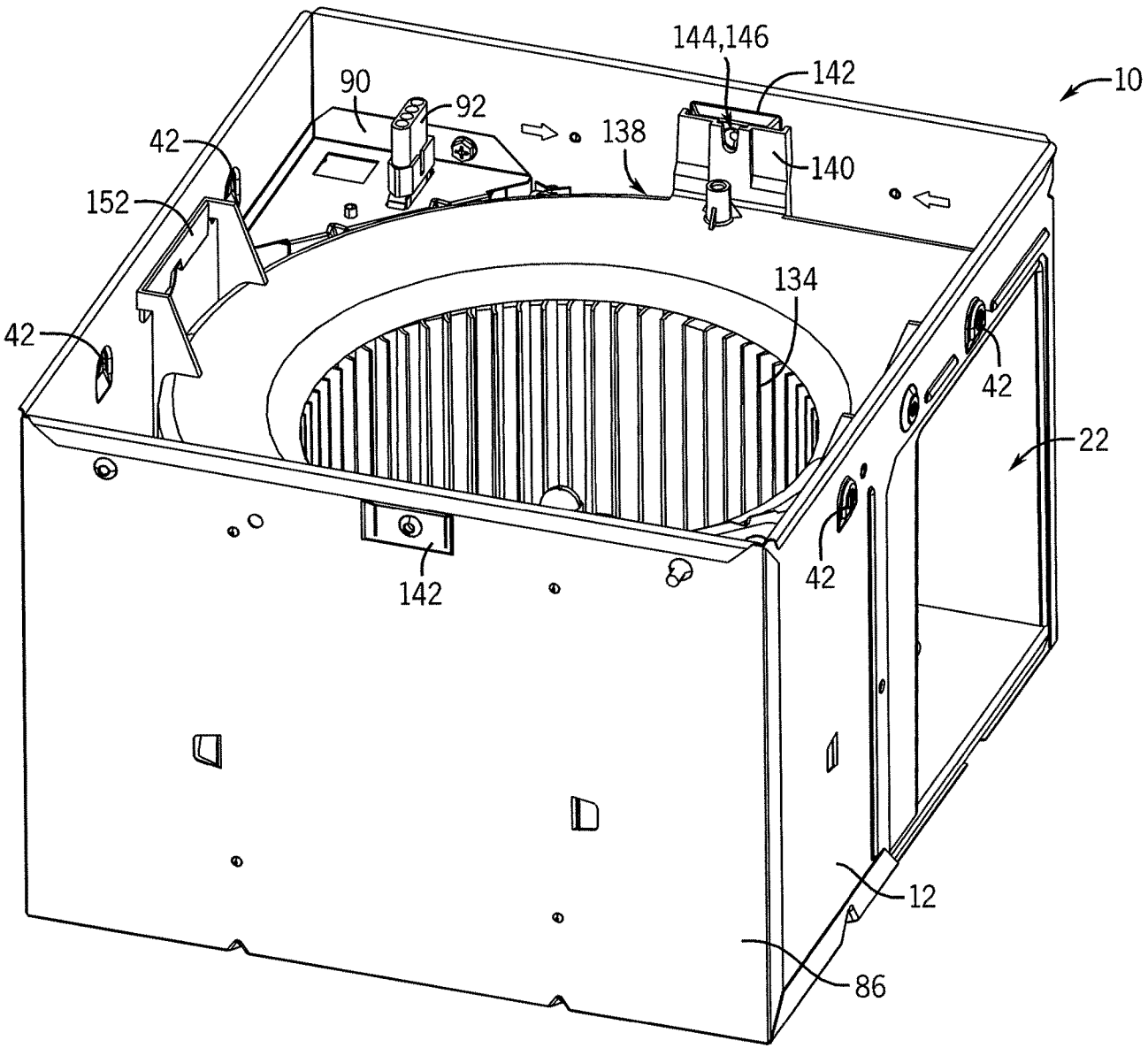
FIG. 22 is a perspective view of a portion of a housing and a ventilating assembly according to one embodiment of the invention.

In some embodiments, the interaction between the coupling tabs 140 and the receiving members 142 can be supplemented or replaced by other coupling techniques. For example, in some embodiments, at least one of the receiving members 142 can comprise a support aperture 144 and at least one of the coupling tabs 140 can comprise a support recess 146, as shown in FIG. 22. In some embodiments, more than one of the coupling tabs 140 and receiving members 142 can comprise a support aperture 144 and support recess 146, respectively. As a result, in some embodiments, after positioning the coupling tabs 140 immediately adjacent to the receiving members 142, a fastener (e.g., a screw, a nail, a bolt, etc.) can be at least partially disposed through the support apertures 144 and support recesses 146 to further couple together the ventilating assembly 14 and the housing 12.

Figure 23:
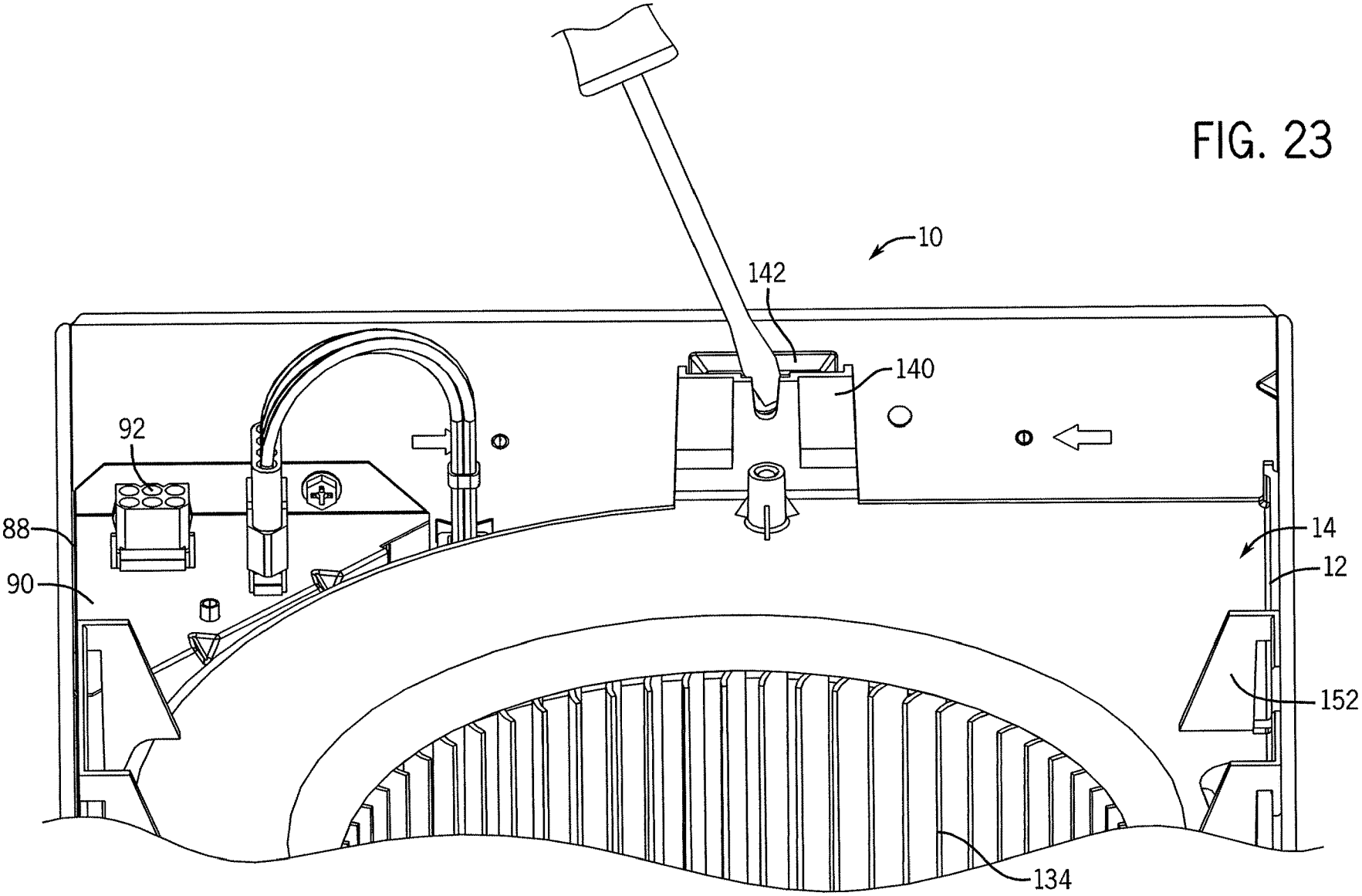
FIG. 23 is a perspective view of a portion of a ventilating system according to one embodiment of the invention.

In some embodiments, the ventilating assembly 14 can be at least partially uncoupled from the housing 12. For example, in some embodiments, the ventilating assembly 14 can be uncoupled from the housing 12 by inserting a device (e.g., a tool, such as a screwdriver) between the receiving members 142 and the coupling tabs 140 to disengage these two elements, as shown in FIG. 23. As a result, the ventilating assembly 14 can be relatively easy to install and/or uninstall.

In some embodiments, at least some of the operational parameters of the motor 28 and fan 134 can be controlled at the motor control compartment 96. For example, in some embodiments, power to the motor 28, and as a result, to the fan 134, can be controlled by the motor control apparatus. As previously mentioned, in some embodiments, all current flowing to the motor 28 can locally originate from the motor control compartment 96 so that control over the motor 28 can be provided by the motor control apparatus. For example, as shown in FIG. 14, in some embodiments, the user/installer can set a flow rate at which the ventilating assembly 14 operates.

As shown in FIG. 14, the flow rate can be set by inserting a device into at least one of the control apertures 100 to manually adjust the rate. For example, in order to exhaust a greater amount of air, the user/installer could adjust the motor control apparatus to a greater flow rate, as measured in cubic feet per minute (CFM) (e.g., adjust the rate to a greater CFM value). Accordingly, in some embodiments, to exhaust air at a greater rate, the motor control apparatus can provide greater amounts of current to the motor 28 to operate at greater rate. Furthermore, in some embodiments, the motor control apparatus can comprise a potentiometer or a potentiometer-like element. As a result, in some embodiments, the motor control apparatus can comprise the capability to substantially or completely infinitely regulate over an extended range of flow rates (e.g., 30 CFM-110 CFM) relative to some conventional control apparatuses capable of only operating at finite flow rates (e.g., 30 CFM, 50 CFM, 75 CFM, 100 CFM, etc.). Furthermore, in some embodiments, the motor 28 can be configured and arranged to generate a generally consistent airflow even under potentially limiting static pressures (e.g., 0.25" wg).

Additionally, in some embodiments, the user/installer can set a predetermined time of operation. For example, in some embodiments, the time of operation can be adjusted via another control aperture 100. In some embodiments, the time selected can comprise a time of operation (e.g., if the time selected is thirty minutes, the motor 28 will operate for thirty minutes after activation).

Figure 29B:
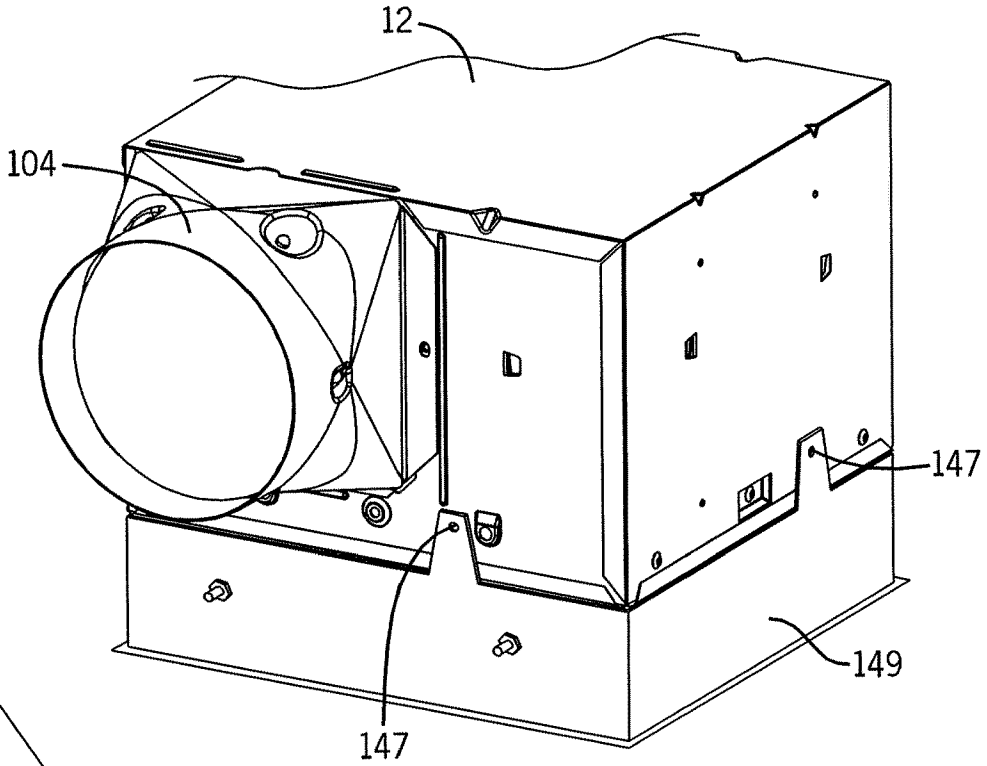
FIG. 29B is a perspective view of a housing and an accessory according to one embodiment of the invention.
Figure 29A:
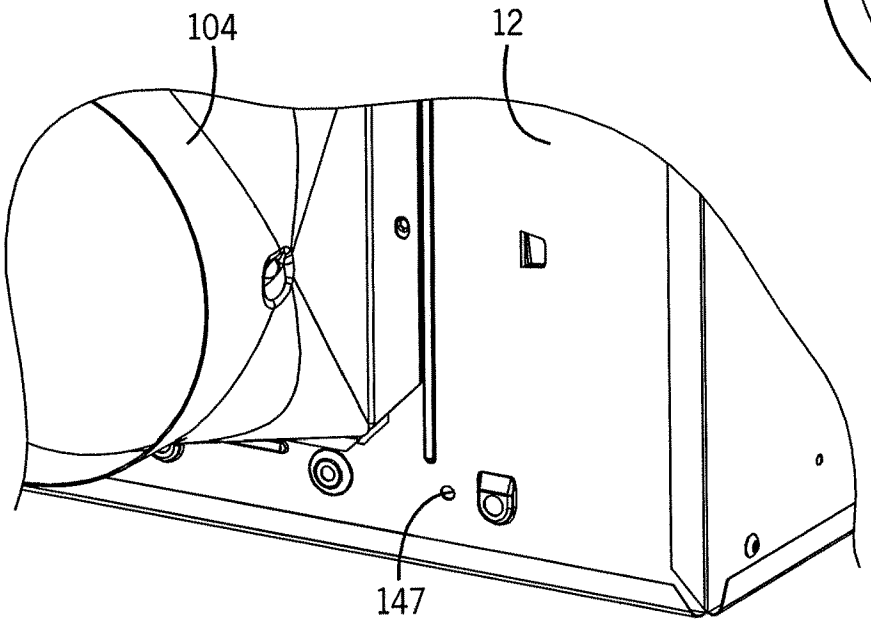
FIG. 29A is a partial perspective view of a portion of a housing according to one embodiment of the invention.

In some embodiments, the housing 12 can comprise one or more mounting apertures 147 (e.g., four mounting apertures 147), as shown in FIGS. 29*a* and 29B. For example, as shown in FIG. 29, the mounting apertures 147 can be disposed through some portions of the housing 12, such as, but not limited to, one or more mounting apertures 147 through each side of the housing 12 (e.g., a four-sided housing could comprise at least four mounting apertures 147). In other embodiments, the housing 12 can comprise other numbers of mounting apertures 147 as desired by the user or manufacturer. In some embodiments, the mounting apertures 147 can be used to couple accessories 149 to the housing 12. For example, as shown in FIG. 29B, an accessory 149, such as a radiation damper, can be coupled to the housing 12 via the mounting apertures 147 to enable the system 10 to be disposed in any variety of locations. In other embodiments, other accessories 149 can be coupled to the housing 12.

In some embodiments of the invention, a grille 148 can be coupled to the housing 12. In some embodiments, the grille 148 can be formed in a generally square-like shape, although the grille 148 can take any shape, including an oval shape, a hemispherical shape, a spherical shape, a pyramidal shape, or any other shape. Further, in some embodiments, the grille 148 can be configured so that it substantially corresponds to the shape of the housing 12. The grille 148 can comprise injection-molded polymers, sheet metal, or any other suitable material.

As shown in FIG. 1, in some embodiments, the grille 148 can be positioned over an open end of the housing 12. In some embodiments, the open end of the housing 12 can be shaped and dimensioned to be received within an open end of the grille 148. The grille 148 can be secured to the housing 12 by one or more snap-fit features on the grille 148 and/or the main housing 12. Additionally, in some embodiments, the one or more snap-fit features can be supplemented or replaced by any variety of couplings, such as screws, bolts, rivets, pins, clamps, glue or other adhesive, and any other similar coupling. In some embodiments, the housing 12 and the grille 148 can be further secured through other coupling practices such as welding, soldering, brazing, adhesive or cohesive bonding material, any combination of the foregoing, or any other similar coupling practice.

Figure 24:
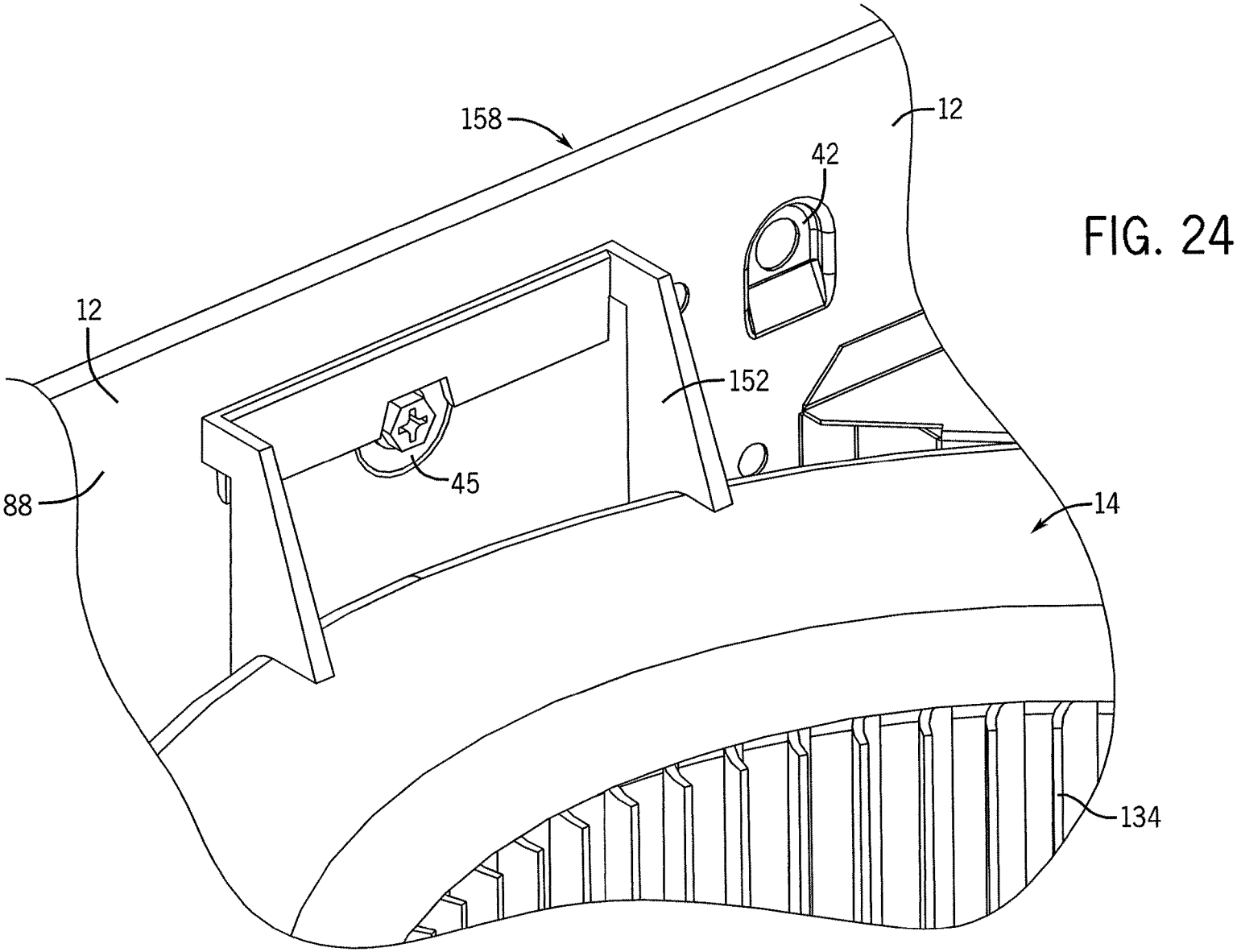
FIG. 24 is an expanded perspective view of portions of a ventilating system according to one embodiment of the invention.

By way of example only, in some embodiments, the grille 148 can be coupled to the housing 12 and/or the ventilating assembly 14 via at least one grille spring 150. As shown in FIGS. 5 and 24, in some embodiments, the ventilating assembly 14 can comprise at least one spring support 152 and the grille 148 can comprise at least one set of spring flanges 154. For example, in some embodiments, the ventilating assembly 14 can comprise two spring supports 152 and the grille 148 can comprise two sets of spring flanges 154. In some embodiments, a portion of one of the grille springs 150 can engage one set of the spring flanges 154 on the grille 148 and another portion of the same grille spring 150 can engage the spring supports 154 on the ventilating assembly 14. In some embodiments, the same process can be repeated for any other grille springs 150 used in the coupling process. As a result, in some embodiments, the grille 148 can remain coupled to the housing 12 and the ventilating assembly 14 via the grille springs 150, but can be extended from the housing 12 a distance substantially equivalent to at least a portion of a length of the grille springs 150 (e.g., to enable access to the interior components of the system 10).

In some embodiments of the invention, the grille 148 can include at least one louver 156. In some embodiments, the grille 148 can comprise a plurality of louvers 156, as shown in FIG. 1. In some embodiments, the louvers 156 can extend across an inlet 158, which can be defined by the housing 12. The louvers 156 can be used for receiving a flow of air. The louvers 156 can be located anywhere on the grille 148. In some embodiments, the location of the louvers 156 can be at least partially determined by airflow path(s) which can be available from the louvers 156, through the inlet 158, and into the ventilating assembly 14. In some embodiments, the louvers 156 can be angled between about zero degrees and about forty-five degrees from vertical when the system 10 is mounted in a horizontal ceiling, although the system 10 can be mounted in other locations. In some embodiments, the louvers 156 can be positioned substantially around a perimeter of a lighting aperture 160 of the grille 148. In some embodiments, the location of the louvers 156 can be selected substantially based on aesthetics, functionality, and other considerations which can be important to a user and/or a manufacturer.

As best seen in FIG. 1, in some embodiments, the louvers 156 can guide air into the system 10. Air can include moisture, steam, exhaust, smoke, effluent, or anything similar. In some embodiments, after passing through the louvers 156 and entering the inlet 158 of the housing 12, the air can enter the ventilating assembly 14, as previously mentioned.

Figure 25:
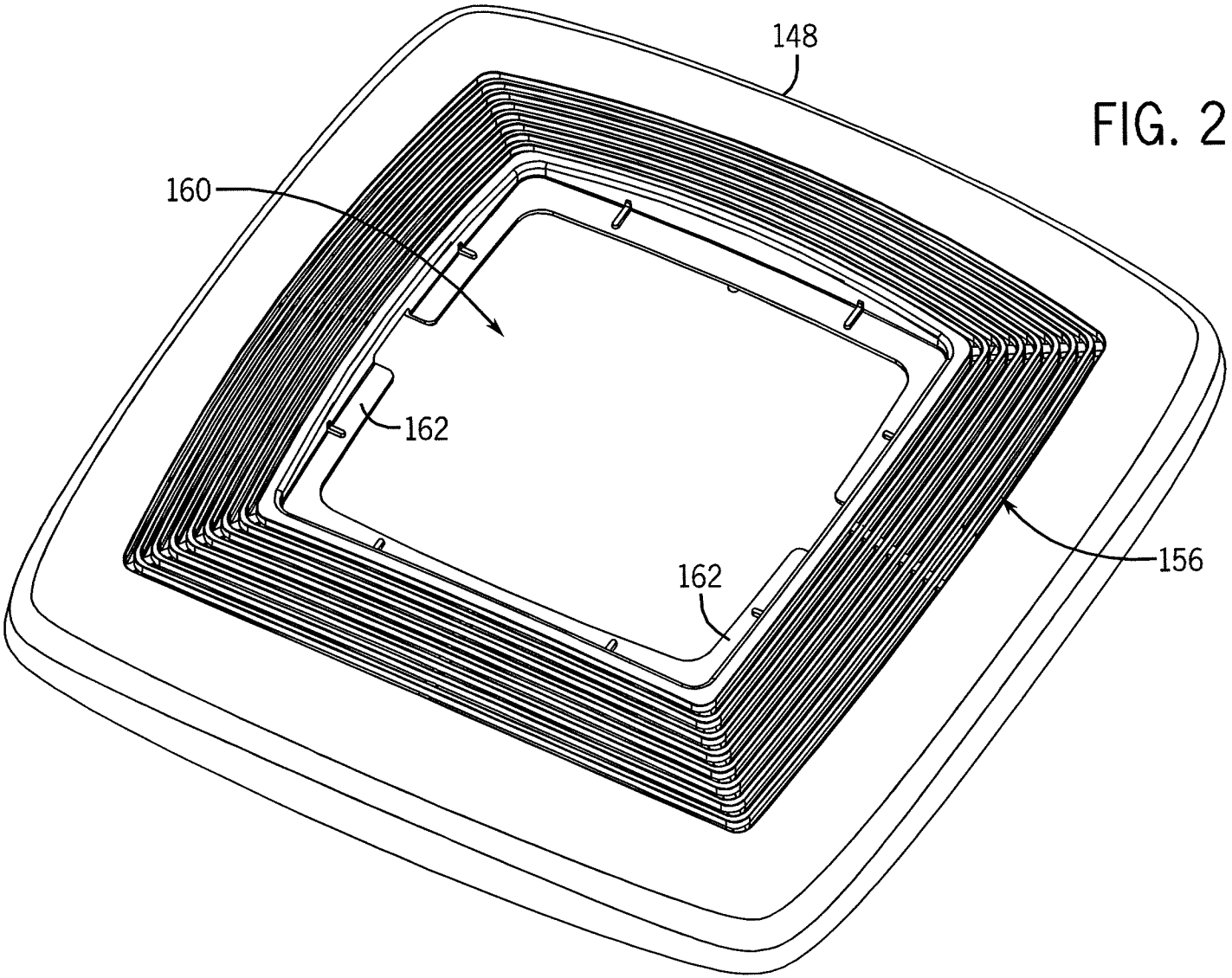
FIG. 25 is a perspective view of a grille according to one embodiment of the invention.

According to some embodiments, the lighting aperture 160 can be located in a generally central area of the grille 148, as shown in FIG. 25. In other embodiments, the lighting aperture 160 can be located generally anywhere on the grille 148. In yet other embodiments, the lighting aperture 160 can include multiple lighting apertures 160 located in either generally central areas of the grille 148 or anywhere on the grille 148. In some embodiments, the lighting aperture 160 can take a generally annular shape. In other embodiments, the lighting aperture 160 can take other shapes, including square, rectangular, polygonal, spherical, elliptical, or any other shape. In some embodiments the shape of the lighting aperture 160 can be selected based on the shape of the lamp housing 16.

In some embodiments, the lamp housing 16 can be dimensioned to be received by or coupled to the lighting aperture 160. In some embodiments, the lamp housing 16 can include a heat-resistant material, heat shielding, and/or reflective surfaces to inhibit heat from contacting various components of the system 10. In some embodiments, the reflective surfaces can generally direct light out of the system 10. In some embodiments, the lighting aperture 160 can generally support, hold, and/or retain the lamp housing 16. In some embodiments, the lighting aperture 160 can include a mounting flange 162 which can be used to support the lamp housing 16. The mounting flange 162 can be located substantially entirely around an inner perimeter of the lighting aperture 160 and can be integral with the lighting aperture 160. In other embodiments, the mounting flange 162 can comprise a plurality of mounting flanges located around the inner perimeter of the lighting aperture 160.

In some embodiments, the lamp housing 16 can be secured to the mounting flange 162 by one or more snap-fit features on the lamp housing 16 and/or the mounting flange 162. Additionally, in some embodiments, the one or more snap-fit features can be supplemented or largely replaced by any variety of coupling, such as screws, bolts, rivets, pins, clamps, glue or other adhesive, and any other similar fastener. In some embodiments, the lamp housing 16 and the mounting flange 162 can be further secured through other coupling practices such as welding, soldering, brazing, adhesive or cohesive bonding material, any combination of the foregoing, or any other similar coupling practice.

Figure 26:
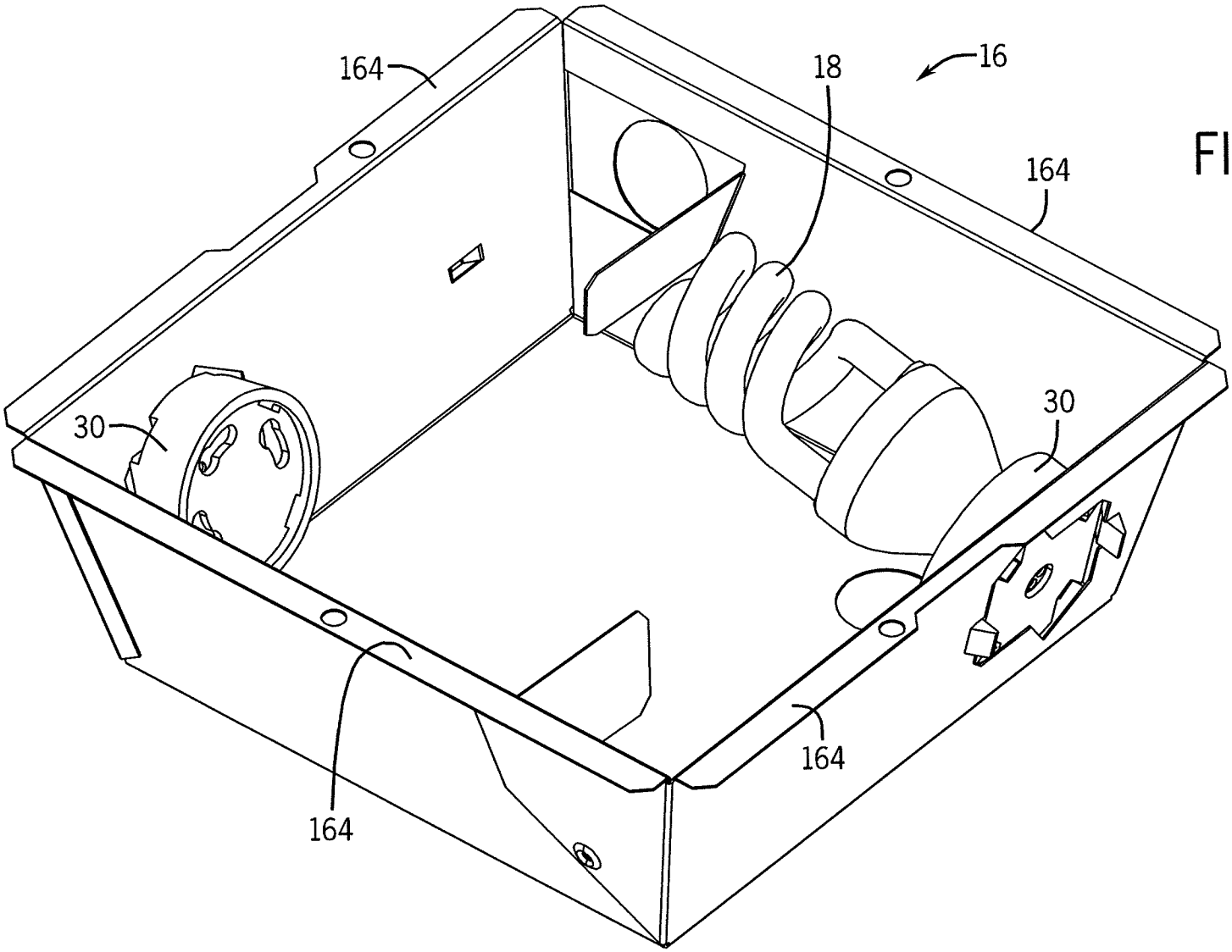
FIG. 26 is a perspective view of a lamp housing according to one embodiment of the invention.

In some embodiments, the lamp housing 16 can include one or more lips, flared edges, flanges, or other features configured and arranged to engage the mounting flange 162, as shown in FIG. 26. In some embodiments, the lamp housing 16 can include a set of peripheral flanges 164 to which the mounting flange 162 can be attached. For example, in some embodiments, the mounting flange 162 can include a set of pins (not shown) that can be received by a set of apertures (not shown) included on the second set of peripheral flanges 164. In some embodiments, the connection between the pins and the apertures can be further secured using any of the previously mentioned coupling methods. Further, in some embodiments, the mounting flange 162 and the lamp housing 16 can include apertures through which any of the previously mentioned fasteners or coupling apparatuses can be passed to secure the mounting flange 162 to the lamp housing 16. In some embodiments, the lamp housing 16 can be directly coupled to the lighting aperture 160 and/or the grille 148 in any suitable manner (e.g., the lamp housing 16 can be physically retained in position between the grille 148 and lens 26). Further, in some embodiments, the lamp housing 16 can be directly coupled to the main housing 12 in any suitable manner.

In some embodiments, the lamp housing 16 can include the electrical socket 30 and at least one illumination device 18, although some embodiments can include more than one electrical socket 30 and one or more illumination devices 18. In some embodiments, the electrical sockets 30 can be connected to the electrical components 20 via at least one of the receptacles 92 disposed on the electrical compartment 90. The illumination devices 18 can contact the electric sockets 30, and, in some embodiments, when activated by the user, the illumination devices 18 can provide illumination to the room, area, or space. In some embodiments, the illumination devices 18 can include incandescent, fluorescent, compact fluorescent, halogen, and other lights and lamps. Further, these lights can comprise flood lights, globe lights, light-emitting diodes (LEDs), or other similar lighting apparatuses, including a combination of any of the above.

Moreover, in some embodiments, the system 10 can comprise other illumination configurations. For example, in some embodiments, the system 10 can comprise a combination of LEDs and other illumination devices as disclosed in U.S. patent application Ser. Nos. 12/902,077 and 12/902,065 which are assigned to the assignee of the present application. The entire contents of these applications are hereby incorporated by reference in this disclosure. Briefly, the system 10 can comprise the capability to emit illumination at different intensities and at different times. Also, in some embodiments, the system 10 can radiate multiple colors of light at different intensities over a predetermined time period.

As illustrated in FIG. 1, in some embodiments of the invention, the lens 26 can be coupled to the system 10. In some embodiments, the lens 26 can aid in diffusing illumination emitted by the illumination devices 18. In some embodiments, the lens 26 can be coupled to the grille 148 in any of a number of the above-discussed coupling techniques, including snap-fitting, fasteners, or adhesives. Alternatively, the lens 26 can be integrally formed with the grille 148.

In some embodiments, one or more power consuming devices, including, but not limited to the motor 28, the illumination devices 18, etc. can be powered by an internal electrical circuit of a building. In some embodiments, as previously mentioned, the electrical connections 20 can originate from the structure into which the system 10 is installed and pass through the clamp aperture 74 of the panel 66 at one side of the housing 12 and can provide power for one or more of the power-consuming elements of the system. In some embodiments, one or more switches, such as wall switches can be used to activate or deactivate any of the power-consuming devices. In some embodiments, two or more separate switches can be used to control the ventilating assembly 14 and the illumination devices 18. In some embodiments, one switch can be used to control both elements.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A ventilating system configured to be secured in a structure, the ventilation system comprising:

a housing including an inlet through which air is received within the housing and an outlet through which the air exits the housing, the housing further comprising an inner surface and an outer surface, wherein the housing defining at least one aperture on the outer surface;

a ventilating assembly being operable to generate a flow of air;

a mounting assembly coupled to a portion of the housing, the mounting assembly comprising:

two first mounting brackets configured and arranged to be immediately adjacent to opposing sides of the housing;

the first mounting brackets not being configured to secure to the structure;

two second mounting brackets;

two support members extending from each second mounting bracket, each support member extending to a position adjacent to one of the first mounting brackets;

two third mounting brackets, each coupled to at least one of the first mounting brackets, each of the two third mounting brackets comprising a first flange extending along an upper edge of at least one of the third brackets and around an upper edge of at least two of the support members, and a second flange extending along a lower edge of at least one of the third brackets and around a lower edge of at least two of the support members, wherein each support member is configured to be at least partially received by the first and second flanges; and at least two tabs, each tab bendable with respect to the second mounting brackets between a substantially vertical position in which the tab aligns with the bracket and a substantially horizontal position in which the tab extends laterally from the bracket to position the tab to engage a structure to which the mounting assembly is coupled.

2. The ventilating system of claim 1 and further comprising an electrical aperture being disposed through a portion of the housing.

3. The ventilating system of claim 2 and further comprising a panel being coupled to the housing substantially immediately adjacent to the electrical aperture, the panel comprising at least one clamp aperture, the panel being configured and arranged to be coupled to at least one of the inner surface and the outer surface, and wherein the panel being configured and arranged so that when the panel is coupled to the housing, the at least one clamp aperture is oriented in one of a first position and a second position.

4. The ventilating system of claim 3, wherein the first position comprises being disposed substantially parallel to the inlet of the housing and the second position comprises being disposed substantially perpendicular to the inlet of the housing.

5. The ventilating system of claim 1, wherein the mounting assembly is configured and arranged to extend and retract.

6. The ventilating system of claim 1, and further comprising a duct adaptor coupled to the duct connector assembly.

7. The ventilating system of claim 6, wherein the duct adaptor comprises a first region, a second region, and a third region, and wherein the first region comprises a diameter substantially similarly sized to a diameter a portion of the duct connector assembly, the second region comprises a lesser-sized diameter relative to the first region, and the third region comprises a transition region where the diameter of the duct adapter varies.

8. The ventilating system of claim 1 and further comprising a damper assembly operatively coupled to a portion of the duct connector assembly.

9. The ventilating system of claim 8, wherein the damper assembly comprises a flap moveably coupled to the duct connector assembly, and wherein a sealing panel is coupled to the flap.

10. The ventilating system of claim 1 and further comprising a grille coupled to at least one of the ventilating assembly and the housing.

11. The ventilating system of claim 10 and further comprising a lamp housing coupled to the grille.

12. The ventilating system of claim 11, wherein the lamp housing is configured and arranged to receive at least one illumination device.

13. The ventilating system of claim 12, wherein the at least one illumination device comprises one of include an incandescent light, a fluorescent light, a compact fluorescent light, a halogen light, and light-emitting diodes.

14. The ventilating system of claim 1, wherein the ventilating assembly comprises a motor being coupled to the support plate, a fan being operatively coupled to the motor, and at least one coupling tab being disposed on a portion of the at least one wall, the at least one coupling tab including a support recess, and wherein the at least one coupling tab is configured and arranged to reversibly engage the housing.

15. A ventilating system configured to be secured in a structure, the ventilation system comprising:

a housing including an inlet through which air is received within the housing and an outlet through which the air exits the housing, the housing further comprising an inner surface and an outer surface wherein the housing defines at least one aperture on the outer surface;

a ventilating assembly being operable to generate a flow of air;

a mounting apparatus coupled to a portion of the housing, the mounting apparatus comprising:

two first mounting brackets, two second mounting brackets, and two third mounting brackets, wherein the first mounting brackets are configured and arranged to be immediately adjacent to opposing sides of the housing;

the first mounting brackets not being configured to secure to the structure;

the first mounting brackets each define at least two lead-in features configured and arranged to substantially align the housing with respect to the mounting apparatus, the at least two lead-in features comprising an alignment plate configured to be parallel to the housing outer surface and at least one guiding plate extending from the alignment plate at an angle to the alignment plate;

the first mounting brackets are configured and arranged to be on substantially opposite sides of the housing as the third mounting brackets;

the third mounting brackets are configured and arranged to couple the housing to the mounting apparatus;

each third mounting bracket coupled to at least one of the first mounting brackets; and the second mounting brackets are configured and arranged to couple the mounting apparatus to a structure, and at least two tabs configured and arranged on the second mounting brackets to at least partially align the mounting apparatus with respect to the structure, and wherein the at least two tabs are capable of being oriented in both of a substantially vertical and a substantially horizontal position.

16. The ventilating system of claim 15 wherein the lead-in features of the first mounting brackets retain the housing, such that a remainder of the first mounting brackets is spaced from the housing thereby providing a clearance portion between the housing and the first mounting brackets that extends along the outer surface of the housing.

17. A ventilating system configured to be secured in a structure, the ventilation system comprising:

a housing including an inlet through which air is received within the housing and an outlet through which the air exits the housing, the housing further comprising an inner surface and an outer surface;

a ventilating assembly being operable to generate a flow of air;

a mounting assembly coupled to a portion of the housing, the mounting assembly comprising:

two first mounting brackets configured and arranged to be immediately adjacent to opposing sides of the housing;

the first mounting brackets not being configured to secure to the structure;

two second mounting brackets;

at least two support members extending from each second mounting bracket, each support member extending to a position adjacent to one of the first mounting brackets; to one of the second mounting brackets;

two third mounting brackets, each coupled to at least one of the first mounting brackets and second mounting brackets, each of the two first mounting brackets comprising at least two lead-in features configured and arranged to substantially align the housing with respect to the mounting apparatus, and a portion of each of the two first mounting brackets extending between the two lead-in features is configured to be spaced from the housing providing a clearance portion.

* * * * *